US005090207A

United States Patent [19]

Gilbertson et al.

[11] Patent Number: 5,090,207

[45] Date of Patent: Feb. 25, 1992

[54] ICE BUILDING, CHILLED WATER SYSTEM AND METHOD

[75] Inventors: Thomas A. Gilbertson, Moraga; Michael R. Meyers, Sonoma, both of

[73] Assignee: Reaction Thermal Systems, Inc., Napa, Calif.

[21] Appl. No.: 620,276

[22] Filed: Nov. 30, 1990

Related U.S. Application Data

[63] Continuation of Ser. No. 284,890, Dec. 6, 1988, abandoned, which is a continuation-in-part of Ser. No. 11,617, Feb. 6, 1987, abandoned.

[51] Int. Cl.[5] ..... F25D 17/02; F28D 20/00

[52] U.S. Cl. ..... 62/59; 62/99; 62/185; 62/434; 62/437; 62/436; 165/104.27; 165/902; 165/10; 137/568

[58] Field of Search ..... 62/59, 99, 185, 201, 62/430, 434, 435, 436, 437; 165/10 A, 18, 902, 104.17, 104.14, 104.27, 104.32, 104.21; 137/565, 568

[56] References Cited

U.S. PATENT DOCUMENTS

| | | | |
|---|---|---|---|
| 2,986,898 | 6/1961 | Wood, Jr. | 62/174 |
| 3,109,298 | 11/1963 | Harnish | 62/324 |
| 3,443,394 | 5/1969 | Kronick | 62/139 |
| 3,773,031 | 11/1973 | Laing et al. | 126/400 |
| 4,194,367 | 3/1980 | Lavik | 62/138 |
| 4,205,656 | 6/1980 | Scarlata | 126/400 |
| 4,211,208 | 7/1980 | Linder | 126/400 |
| 4,248,291 | 2/1981 | Jarmul | 165/4 |
| 4,283,925 | 8/1981 | Wildfever | 62/434 |
| 4,393,918 | 7/1983 | Patry | 165/10 |
| 4,401,449 | 8/1983 | Martin et al. | 62/59 |
| 4,446,910 | 5/1984 | Miller et al. | 165/1 |
| 4,502,289 | 3/1985 | Kayama | 62/185 |
| 4,559,788 | 12/1985 | McFarlan | 62/98 |
| 4,565,242 | 1/1986 | Yano et al. | 165/10 |
| 4,612,974 | 9/1986 | Yanadori et al. | 165/10 |
| 4,613,444 | 9/1986 | Lane et al. | 252/70 |
| 4,637,219 | 1/1987 | Grose | 62/199 |
| 4,656,836 | 4/1987 | Gilbertson | 62/185 |
| 4,671,077 | 6/1987 | Paradis | 62/324.1 |
| 4,768,579 | 9/1988 | Patry | 165/10 |
| 4,856,296 | 8/1989 | Shu | 62/430 |

FOREIGN PATENT DOCUMENTS

| | | |
|---|---|---|
| 0122189 | 10/1984 | European Pat. Off. . |
| 0126248 | 11/1984 | European Pat. Off. . |
| 3005450 | 8/1981 | Fed. Rep. of Germany . |
| 0912186 | 8/1946 | France . |
| 2469678 | 2/1984 | France . |
| 0143459 | 3/1979 | Japan . |
| 0148348 | 9/1983 | Japan . |
| 0158989 | 9/1984 | Japan . |
| 8612374 | 4/1986 | PCT Int'l Appl. . |
| 2173886 | 10/1986 | United Kingdom . |

OTHER PUBLICATIONS

"Ibis Ice Ball Inventive Storage", Eisspeicherung Technisches Handbuch, 6/1986.

"Cryogel Sa User Manual", 5/1986.

*Primary Examiner*—Harry B. Tanner

*Attorney, Agent, or Firm*—Lowell C. Bergstedt

[57] ABSTRACT

A chill water system combining a storage vessel 10, a multiplicity of ice encapsulating units 11 contained in the vessel and a chiller system 60. The storage vessel contains a volume or glycol and water solution having a freezing point of about twenty six degrees F. The ice encapsulating units 11 comprise sealed containers filled with a deionized water. The containers have imperfect geometric shape and deformable wall structures to permit an increasee in enclosed volume as said water therein freezes. Chiller system 60 is operatively associated with the vessel and cools the glycol and water solution to about twenty six degrees to freeze the water in the containers 11. A topping tank 90 and an inventory tank 93 receive liquid from the storage vessel 10 as the ice encapsulating units 11 freeze and expand in volume.

22 Claims, 6 Drawing Sheets

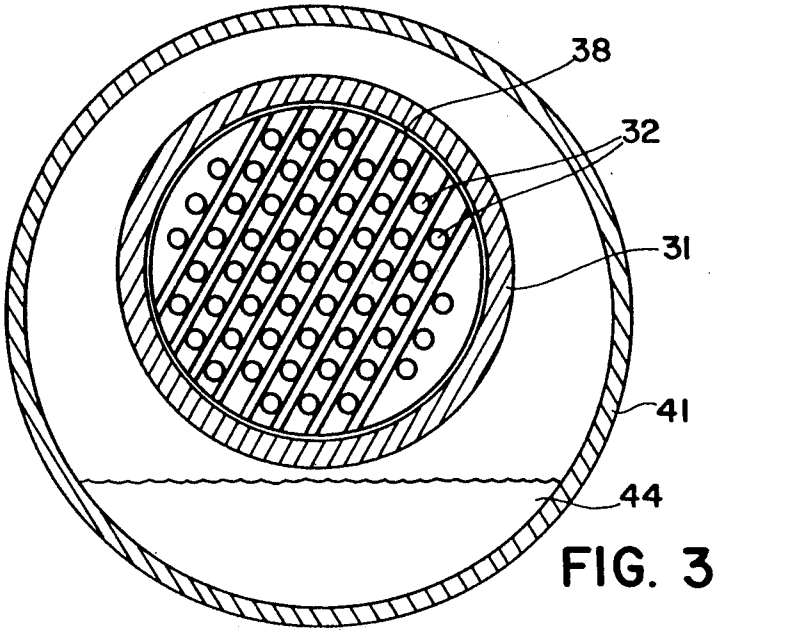
FIG. 3
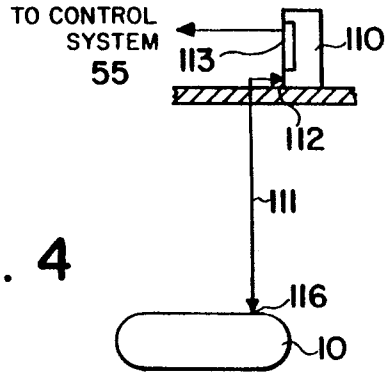
FIG. 4
FIG. 5
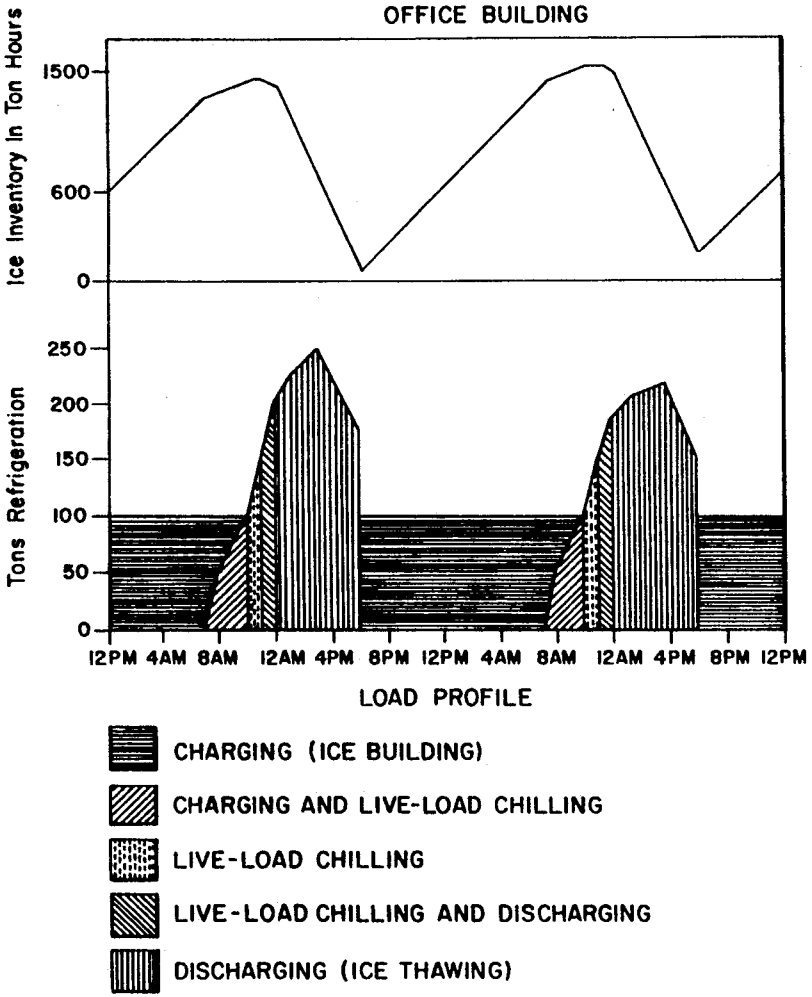

ICE BUILDING, CHILLED WATER SYSTEM AND METHOD

CROSS-REFERENCE TO RELATED APPLICATIONS

This application is a continuation of our copending U.S. application Ser. No. 07/284,890 filed Dec. 6, 1988, abandoned, (originally filed as PCT/US88/00325 on Feb. 8, 1988), which is a continuation-in-part of U.S. patent application Ser. No. 07/011,617, filed Feb. 6, 1987, abandoned, and entitled "Ice Building, Chilled Water System and Method."

FIELD OF THE INVENTION

This invention relates generally to systems and methods for producing chilled water to be used, for example, in air conditioning and process cooling applications. More specifically, this invention relates to chilled water systems and methods which involve thermal energy storage based on building ice during nighttime hours and harvesting the ice to produce chilled water during peak electrical load demand during the daytime. The term "water" is sometimes used to designate generically the working liquid of the system which is typically water treated with rust inhibitors or water which has other chemicals added to alter the freezing temperature characteristics thereof.

BACKGROUND OF THE INVENTION

A number of different systems and methods for achieving thermal energy storage are in commercial use today. These systems fall into several general categories: ice on coil systems, ice harvester systems, brine circulation systems, slush making systems, and ice encapsulating storage systems using eutectic salts or water.

Ice on Coil Systems

The largest number of units on the market are "ice on coil" systems in which the ice is actually grown on the outside of refrigerant carrying coils that are placed in a storage tank filled with water. Gilbertson U.S. Pat. No. 4,656,836 discloses an ice-on coil system which represents the most advanced state of this type of prior art system. Ice on coil systems have a number of problems and limitations that have impeded their wide acceptance. They require the use of long coils of pipe inside the storage tank to provide enough ice growing surface to produce the number of ton-hours of ice storage required for the application. These long coils are expensive from a materials and fabrication standpoint. Furthermore, they typically require the use of a large volume of refrigerant to charge the system. This refrigerant charge is expensive and loss of the entire refrigerant charge if a leak develops is an inherent risk. Ice on coil systems grow ice only to the point of occupying about fifty percent of the volume of the storage tank. Thus these systems are typically specified as requiring about three cubic feet per ton-hour of ice storage. While the Gilbertson '836 patent discloses an ice on coil system with closed, pressurized storage tanks for direct connection to the chilled water utilization system, most ice on coil system use open atmospheric tanks and require a separate heat exchanger interface to any chilled water utilization system having a substantial static pressure head.

Ice Harvestor Systems

In ice harvester systems, ice is first built on a heat transfer surface (evaporator) cooled with a liquid refrigerant and then harvested off of the surface by mechanical means or by using a flash defrost cycle to melt the layer of ice near the heat transfer surface. The ice building and harvesting equipment must be physically mounted over the storage tank into which the ice is dropped when harvested. Ice harvester systems occupy a large space, are complicated and difficult to install, and require about 3.3 cubic feet per ton hour of storage due to the geometric profile assumed by the ice as it falls into the tank.

Brine Systems Brine systems are like ice on coil refrigerant systems except that a twenty-five to thirty percent brine solution is cooled in a separate chiller and then circulated through plastic pipe coils in the storage tank to build ice on the coils. This same brine solution is circulated through the coils and the load to harvest the cooling effect of the ice built on the coils. These brine systems have reduced heat transfer efficiency and require more pumping horsepower due to the density and viscosity of the working fluid. They also require larger heat transfer coils on the load side of the system compared to chilled water systems that use treated water or a weak brine solution.

Brine systems are difficult to use in retrofitting an existing chill water installation because the brine forces a derating of the already installed system components on the load side. Substantial additional costs may be required to install larger coils in the load side equipment. The brine type of thermal storage systems are typically specified at about 4.2 cubic feet per ton hour of ice storage.

Slush Ice Producers

There are also systems currently available to produce slush ice for a thermal storage system. One such system uses a large diameter, horizontally disposed chiller tube and low velocity flow of the water through the tube together with an impeller type of agitator to keep the slush ice moving through the chiller system. Another system uses an arrangement of large diameter vertical chiller tubes, each having a highly polished interior surface down which a film of water flows, gradually turning to ice on the chilled surface and then droping off the end of the tube into the storage tank. Both of these systems are complex, relatively expensive and difficult to install.

Another slush ice producing system is disclosed in Martin et al. U.S. Pat. No. 4,401,449. In this system, water is pumped at high volume through a serpentine chiller coil. The '449 patent teaches that ice crystals are formed on the interior walls of the chiller coil and are eventually scrubbed off by the high velocity of the water flowing through the coil. The ice crystal and water mixture is collected in an ice accumulation tank at atmospheric pressure and the patent states that formation of additional ice crystals is enhanced by the reduction in pressure as the mixture leaves the chiller coil.

Slush ice systems do not have a high ice packing density and require from 2.5 to 3.0 cubic feet per ton-hour of ice storage. Control of the refrigeration side of the system during ice production can be difficult.

Ice Encapsulating Systems

In ice encapsulating systems, the ice forming medium is stored in special containers placed in a storage vessel and a chilled liquid is circulated over the containers to freeze the encapsulated medium during the ice building cycle. During the thawing cycle, a liquid is pumped over the containers to be cooled and then supplied to the cooling load circuit

Eutectic Salt Systems

Eutectic salts stored in special containers are used in one type of ice encapsulating system. These salts freeze without expansion at about forty-seven degrees F. and thus produce chilled water at about fifty degrees F. compared to the forty-two to forty-five degree F. temperatures which are achieved in most chill water systems. These higher chill water temperature require major upsizing of the load side heat transfer components to achieve the rated cooling. This adds considerable expense in retrofit installations. Thus these eutectic systems do not provide one of the major advantages of ice building thermal energy storage systems. That advantage is to produce supercooled water for the load side and all the accompanying benefits of actual downsizing of the load side piping, the water coils in the air handling units and the air blower horsepower. These eutectic salt systems typically require about 5 cubic feet per ton hour of storage so ice storage efficiency is low. Leakage of the containers holding the eutectic salt material with resultant corrosion of system components is a risk in these systems.

Rigid Sphere System

Another prior art system stores negative thermal energy for use in cooling in sealed rigid plastic spheres which are either filled with a special liquid chemical that does not expand when it freezes or are partially filled with water to allow for internal expansion during freezing. This type of system is expensive and requires special handling of the thermal storage spheres because they must be filled and sealed at the factory. This creates additional shipping expense due to the weight of the filled spheres.

These rigid sphere ice encapsulating systems require between 2.0 and 2.5 cubic feet per ton-hour of ice storage. Furthermore, if standard copper tube chillers are used to chill the working fluid, a twenty-five to thirty percent glycol in water solution is used to prevent freeze up of liquid in the chiller tubes. Such a freeze up would rupture the copper tubes and destroy the chiller. This concentration of glycol reduces the heat transfer efficiency in the chiller and in the load side chilled water coils and requires use of higher pump horsepower to pump the more viscous liquid.

In general all of the prior art systems have one or more limitations of cost, complexity, size or configuration restrictions. These limitations have tended to discourage the use of thermal storage technology despite the otherwise clear social and economic advantages of the thermal storage concept. This is especially true of the retrofit segment of the market. It is difficult and expensive to adapt most of the prior art systems for retrofitting existing chilled water air conditioning systems with ice building thermal storage components. In particular, the prior art systems are ill-suited from a cost and performance standpoint to be used in retrofit projects involving medium-sized conditioned spaces on the order of 30,000 to 50,000 square feet.

There is a definite need in the art for an improved ice building, thermal storage system that will accelerate the acceptance of this technology both for new construction projects and for retrofitting existing commercial installations of all sizes from medium sized projects (30–50,000 square feet) to extra large projects (over 100,000 square feet).

SUMMARY OF THE INVENTION

Objects of the Invention

The principal object of this invention is to provide an improved ice-building thermal storage system and method.

It is another object of this invention to provide an ice-building thermal storage system and method which is simple to install and operate.

It is another object of this invention to provide an ice-building thermal storage system and method which has improved volumetric efficiency of ice storage.

It is another object of this invention to provide an improved chiller system for use in ice building thermal storage systems.

It is another object of this invention to provide a liquid chiller system which has improved operating efficiency and afer to operate.

It is another object of this invention to provide an ice building and storage system that includes a chiller system that is capable of operating in both ice building and live load chiller modes.

It is another object of this invention to provide an improved ice-building thermal storage system and method in which ice storage is maintained in a closed vessel without pressurization thereof.

It is another object of this invention to provide an improved system and method for ice building and storage which is adaptable for use in both closed and open tank storage applications.

It is another object of this invention to provide an ice-building thermal storage system that is economically feasible to use in medium-sized original construction or retrofit projects.

It is another object of this invention to provide an ice-building thermal storage system with accurate inventory measurement of stored ice charge.

Features and Advantages of the Invention

One aspect of this invention feature a chill water system which combines a structural arrangement defining a vessel for containing a volume of a first liquid having a first freezing temperature with a multiplicity of ice encapsulating units disposed in the vessel and occupying a major portion of the volume thereof. Each of the ice encapsulating units comprises a sealed container and is filled with a second liquid having a second freezing temperature higher than the first freezing temperature and characterized by volume expansion during freezing. The container arrangement is characterized by imperfect geometric shape and deformable wall structures to permit an increase in the enclosed volume of the container as the second liquid freezes. Also included is a liquid chilling system operatively associated with the vessel for cooling the first liquid in the vessel to a temperature above the first freezing temperature and below the second freezing temperature to freeze the second liquid in the container arrangement.

The liquid chilling system preferably includes a chiller system for continuously withdrawing a volume of the first liquid from the vessel, transporting the volume of first liquid at high velocity across a heat transfer surface maintained at a temperature below the second freezing temperature to cool the volume of first liquid to temperature below the second freezing temperature, and returning the volume of first liquid to the vessel. In addition a control system is provided for controlling the chiller means to continue its operation until the first liquid in the vessel is chilled to a temperature value below the second freezing temperature and above the first freezing temperature for a period of time sufficient to freeze the second liquid in the ice encapsulating units.

The preferred chiller system includes a heat exchanger comprising an elongated cylindrical shell having inlet and outlet headers at the ends thereof and a multiplicity of sections of small bore tubing extending between the headers and disposed in a closely spaced parallel bundle configuration. A liquid pumping system withdraws the first liquid from the vessel, pumps it through the inlet header and into the tubes at high velocity, and then returns it from the outlet header to the vessel. A refrigeration system continuously floods the interior of the chiller shell and the exterior of the tubes with liquid refrigerant to cool the first liquid passing through the tubes. Preferably, the mass flow of the liquid refrigerant is at least about twice the amount required to be evaporated to provide the refrigeration capacity desired for the heat exchanger.

Preferably each of the small bore tubes in the heat exchanger is formed from stainless steel having a wall thickness capable of withstanding the pressures caused by any freeze up of the liquid in the tubes that may inadvertantly occur if liquid velocity therethrough is not maintained or the overall refrigeration system malfunctions. The thick wall stainless steel tubes also preclude destructive erosion of the tube walls by the high velocity liquid pumped therethrough.

It is also preferable that the heat exchanger shell be mounted generally concentrically within a surge tank that contains a volume of cold liquid refrigerant and that a refrigerant injector system receiving cold liquid refrigerant from the surge tank and hot liquid refrigerant from a refrigerant compressor and condenser combination be used to inject an overfeed of liquid refrigerant into the shell of the heat exchanger (e.g. approximately twice the mass flow of refrigerant required for evaporation by the load through this circuit). This produces the advantage that the velocity of liquid refrigerant across the heat exchanger tubes together with the boiling action of the refrigerant enhances the heat transfer from heat exchanger tubes to the refrigerant.

It is preferable that each of the ice encapsulating units comprises a molded plastic container having a neck portion formed on one end thereof with external screw threads for mounting a cap thereover. A screw on cap having a self adhesive liner is provided for mounting on the neck of the container. This enables the ice encapsulating units to be shipped empty to an installation site and then filled with an appropriate liquid. Deionized water is preferred for filling the ice encapsulating units because of its advantageous freezing characteristics. It has a higher initial freeze temperature than tap water and maintains a consistent freeze temperature for the remaining liquid. In tap water impurities are increasingly concentrated in the unfrozen volume of liquid, further depressing the freeze point.

To further improve the freeze characteristics of the liquid inside the ice encapsulating units, a small volume of a freeze enhancement material is placed therein. This aids in the initial formation of ice within the container by raising the initial freeze temperature, i.e. the temperature at which the first ice crystals start to form in the container.

In a preferred embodiment, a major portion of the ice encapsulating units comprise a first configuration of molded plastic container that has generally the shape of a regular parallelepiped and is adapted to hold at least several gallons of liquid. The major top and bottom walls of the container have length and width dimensions at least several times greater than the smaller dimension of the side and end walls thereof and have a wall thickness providing substantial wall flexibility to permit expansion of the internal volume of the container. This permits the ice encapsulating units to be stacked one on top of another as well as side to side and end to end to form a compact three dimensional array of containers in the vessel. At least one of the top and bottom walls of the container has an arrangement of projections formed thereon for spacing major wall sections lying adjacent the projections a short distance away from a top or bottom wall of an adjacent container when stacked one on top of the other. This forms liquid flow channels between a top wall of one container and a bottom wall of an overlying container. These liquid flow channels also provide space for volume expansion of the containers during formation of ice therewithin.

The ice building, chill water system of this invention is readily adapted for providing chilled liquid to an air cooling system of a building using a vessel having a closed configuration. In such an overall system, an arrangement is provided for controllably pumping the first liquid to the air cooling system to provide cooling of the building accompanied by gradual melting of portions of ice within the ice encapsulating units.

In this adaptation of the more general inventive concept, a topping tank is mounted above the highest point of the building to which the chilled liquid is to be supplied. This topping tank is open to atmospheric pressure and has an inlet port in a lower wall section thereof and an outlet port formed in an upper wall section thereof. The inlet port is connected to the vessel to receive volumes of the first liquid displaced from the vessel as ice is formed in the ice encapsulating units. The topping tank has a volume comprising a small fraction of the total volume of liquid displaced from the vessel when the second liquid in the ice encapsulating units is completely frozen.

Also, in this adaptation, an inventory tank is mounted at or near grade level and open to the atmosphere with an inlet port at an upper wall portion thereof and an outlet port at a lower wall portion thereof. The inlet port is connected to the outlet port of the topping tank to communicate overflow volumes of the first liquid from the topping tank to the inventory tank. This inventory tank has a volume at least as large as the total volume of liquid displaced from the vessel when the second liquid in the ice encapsulating units is completely frozen.

An inventory pump is connected to the outlet port of the inventory tank for pumping volumes of the first liquid from the inventory tank to the vessel or alternatively directly to the topping tank. Liquid level gauges are mounted in the topping tank and the inventory tank.

A pump control arrangement is coupled to the first level gauging means for turning on the inventory pumping means when the liquid level in the topping tank falls to a prearranged lower level and turning off the inventory pumping means when the liquid level in the topping tank rises to a prearranged upper level.

A control arrangement is coupled to the second level guaging means for turning off the liquid chilling system when the level of liquid in the inventory tank rises to a precalibrated level indicating that substantially all of the second liquid in all of the ice encapsulating units is frozen.

This invention also features a method for providing chilled liquid to a chilled liquid utilization circuit. This method involves forming a vessel adapted for containing a volume of a first liquid characterized by a first freezing temperature. A large number of ice encapsulating units are formed by the steps of:

forming a large number of plastic containers characterized by imperfect geometric shape and deformable wall structures which permit an increase in the enclosed volume of the container due to freezing of a liquid therewithin;

filling the containers with a second liquid characterized by a second freezing temperature substantially above the first freezing temperature; and then sealing the containers against escape of the second liquid.

These ice encapsulating units are then placed in the vessel and at least a major portion of the volume of the vessel not occupied with the ice encapsulating units is filled with the first fluid. The first fluid is chilled during an ice building cycle to a temperature above the first freezing temperature and substantially below the second freezing temperature for a period of time sufficient to freeze the second fluid within the ice encapsulating units. The first liquid is circulated through the closed vessel and the utilization circuit during a load cooling cycle, thereby melting the ice in the ice encapsulating units.

In general this invention provides a number of important advantage over the prior art systems. The entire system with the exception of the refrigeration plant has no moving parts and is very easy to manufacture, install and operate. Moreover, the system is safe and rugged. For example, even a freeze up of the heat exchanger will not damage the system. It can be used with a wide variety of standard refrigeration compressor and condenser units and can be manufactured in various standard size modules to handle different cooling and ice storage requirements. It can also be installed as multiple units to achieve the chiller capacity required for a large installation.

The preferred chiller system with the heat exchanger mounted inside a surge drum uses a much smaller refrigerant charge than ice on coil systems and other prior art systems. It is capable of close approach operation, i.e. with the temperature delta between the liquid leaving the heat exchanger and the temperature of the refrigerant throughout the heat exchanger shell being only a few degrees apart, e.g. a liquid temperature of about 26 degrees F. and a refrigerant temperature of about 20 degrees for a six degree delta. The 20 degree F. suction temperature of the refrigerant is advantageous because it reduces the horsepower requirement for the refrigerant compressor. The closer the discharge water temperature and the suction temperature are to each other the more efficient the system operation. Close approach operation is facilitated by the velocity of the liquid through the small bore heat exchange tubes. The system can be advantagously operated with a small temperature delta between the entering and leaving liquid, e.g. entering temperature of 28.5 degrees F. and leaving temperature of 26 degrees F. The no-harm freeze up feature mentioned above is an additional advantage.

The chiller system of this invention is also head pressure independent. It can operative effectively with a refrigerant discharge pressure from the condenser as low as one hundred psig (sixty degree F.). This improves nighttime operation of the overall system.

The ice encapsulating unit feature of this invention provides the advantage of increasing the ice storage efficiency of the system over prior art systems. Storage efficiencies for ice on coil, ice harvester and slush ice systems are in the range of forty percent to sixty percent. The system of this invention with the preferred configuration of ice encapsulating units is capable of storing at least about sixty-five to seventy percent of the storage vessel volume as ice within the ice encapsulating units.

While other prior art system that use ice encapsulating units may achieve close to this same level of ice storage efficiency, the system of this invention has the additional advantage that the ice encapsulating units are filled with water and expand in volume. This improves the ice storage efficiency and permits detection of the volume of ice built by measuring the volume of liquid displaced by the expansion of the ice encapsulating units.

The system of this invention is preferably implemented in a closed tank arrangement with system pressure provided by the connection to the topping tank. The invention can also be used in an open atmospheric tank configuration. If desired, the invention could also be used in closed, pressurized tanks, such as are disclosed in the above referenced Gilbertson patent, but the closed tank storage is inherently more simple and safer, and thus the preferred approach.

The combination of the ice encapsulating unit storage feature and the liquid chiller feature of this invention may advantagously be implemented with the primary fluid in the storage vessel comprising a ten to fifteen percent glycol solution. This concentration of glycol has a small effect on the heat transfer and pumping characteristics of the working fluid. It does not require any upsizing of load side coils such as characterizes more concentrated brine systems with glycol concentrations of twenty five to thirty percent. In a retrofit installation this means that the cost of converting to larger water coils is avoided by using the system and method of this invention. A ten to fifteen percent glycol solution is not very much different in its operating characteristics from the conditioned water that is typically used in chill water systems to inhibit rust formation.

The ice encapsulating units may be filled with deionized water for a freezing point differential between the glycol and the water of about six degrees. As is well known, ice will usually not begin forming in a closed container until the temperature has been lowered several degrees below the normal freeze temperature of the liquid. However, once ice starts to form, it will continue to grow as long as the liquid is maintained at the normal freezing temperature. The volume of freeze enhancement material placed in the ice encapsulating units enables the deionized water to begin to freeze at a higher initial temperature and thus improves the overall freeze characteristics of the system.

For installations in which a colder water exit temperature is desirable, the ice encapsulating units of this invention may be filled with a mixture of water and a chemical that lowers the freezing point. The glycol concentration in the storage tank water and the suction temperature of the refrigerant may be adjusted as necessary to maintain a sufficient temperature delta between the solution in the ice encapsulating units and the liquid circulating through the storage vessel.

The ice encapsulating unit arrangement of this invention lowers the amount of glycol required to achieve the desired glycol concentration in the storage tank. Of course, where the glycol solution is also circulated directly through the load, the volume of glycol required is a function of the total volume of liquid circulating through the chilled water system.

Other objects, features and advantages of this invention will become apparent from a consideration of the following detailed description of the invention taken in conjunction with the accompanying drawings.

BRIEF DESCRIPTION OF THE DRAWINGS

FIG. 3 is a section view of a chiller system in accordance with this invention and taken along the lines 3—3 in FIG. 1.

FIG. 4 is a partial schematic drawing illustrating an alternative topping tank arrangement in accordance with this invention.

FIG. 5 is a graph illustrating a sequence of operating modes for an ice building, chill water system in accordance with this invention.

DETAILED DESCRIPTION OF INVENTION EMBODIMENTS

Figures 1, 2:
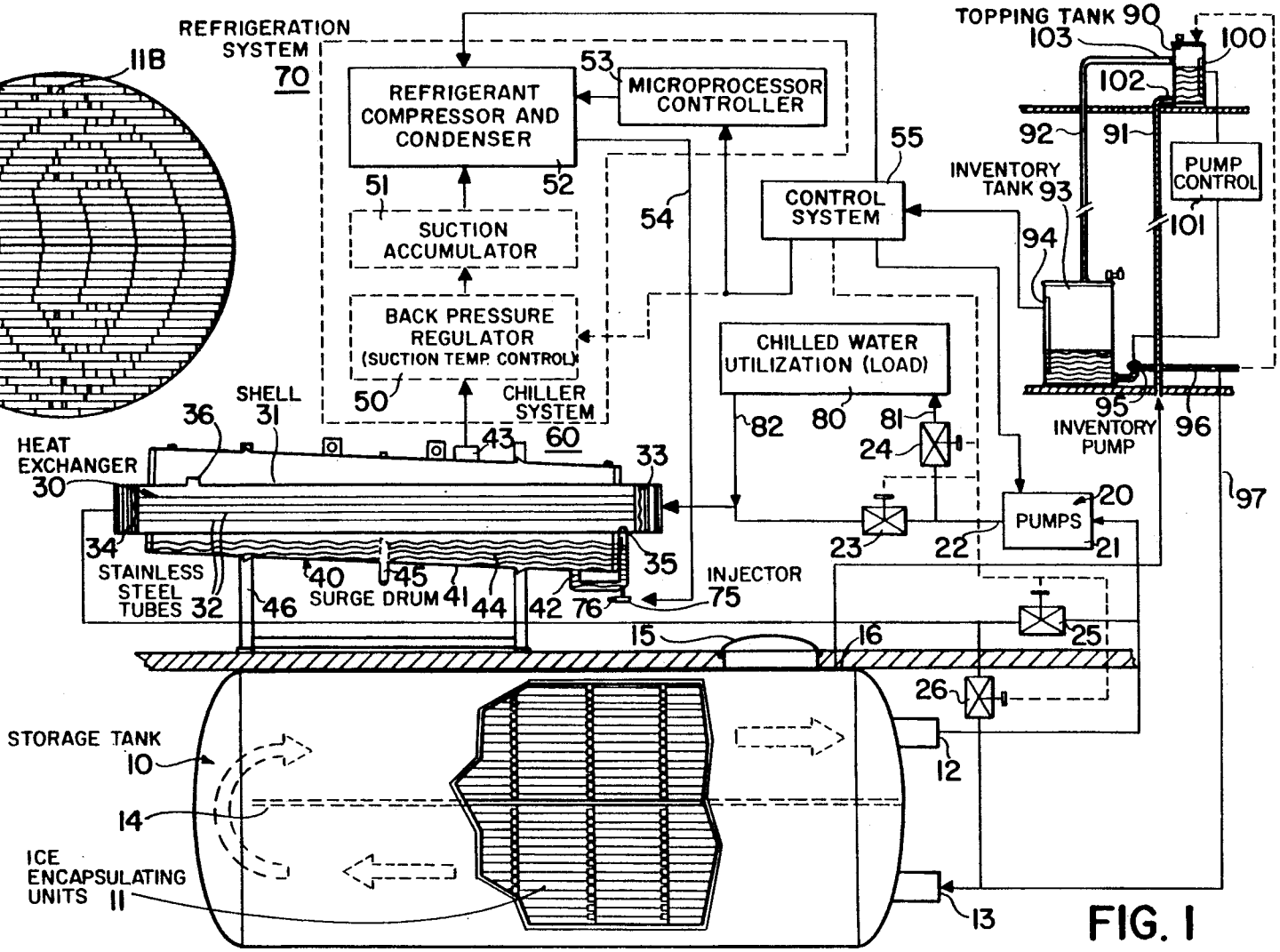
FIG. 1 is a schematic drawing of one embodiment of an ice storing chilled water system in accordance with this invention.
FIG. 2. is a vertical section view through a storage tank illustrating a packing arrangement for ice encapsulating units in accordance with this invention.

FIG. 1 illustrates the major components of a system for ice building and storage in accordance with this invention. These components include a storage vessel or tank 10 with ice encapsulating units 11 placed therein, a liquid chiller system 60, and a refrigeration system 70. Although the components of the system are shown in FIG. 1 as being located near one another, it should be understood that one of the advantages of this invention is that the various components can be located remote from each other. For example, the storage tank 10 can be buried underground in the basement of a building or under an outdoor parking lot. The chiller system can be located in the basement equipment room of the building. The refrigeration system can be located at a distance from both, but it is generally preferrable for the chiller system and the refrigeration system to be close together to minimize the distance that the refrigerant travels between the two systems.

The system of this invention lends itself readily to a packaged chiller approach in which the chiller system 60 is packaged with the compressor and condenser of the refrigeration system. In this approach, all of the connections between the units are made at the factory and the refrigerant charge is loaded at the factory. This simplifies installation of the system since only water side connections are then required.

FIG. 1 shows a structural arrangement including a storage vessel 10 with a multiplicity of ice lenses 11 disposed throughout the internal volume of the vessel. Vessel 10 has an outlet 12 and an inlet 13. Outlet 12 is connected in a liquid flow circuit through a chiller pump 20 and a heat exchanger 30 which is part of a liquid chilling system, including chiller system 60 and refrigeration system 70, and back into the inlet 13. Heat exchanger 30, shown in cross-section in FIG. 3, comprises a generally cylindrical shell 31 having a multiplicity of small bore stainless steel tubes disposed in a mutually separated parallel arrangement between an inlet header 33 and an outlet header 34. Shell 31 has a refrigerant inlet 35 near one end and a refrigerant outlet 36 near the other end. Additional structural details of of heat exchanger 30 will be given below.

Heat exchanger 30 is disposed in a generally concentric orientation within a hollow cylindrical surge drum 40. Surge drum 40 comprises a steel shell 41 preferrably canted slightly relative to a horizontal plane so that a pool of liquid refrigerant 40 therewithin will have a greater depth and thus a greater liquid head pressure at the refrigerant outlet port 42 which is located in a bottom wall of the surge drum near one end. The outlet port 42 is preferrable placed near the refrigerant inlet 35 of the heat exchanger 30. Surge drum 40 has a refrigerant suction port 43 located in a top wall portion and communicates with a refrigerant system 70. Surge drum 40 preferably has a layer of insulation (not shown) surrounding the shell 44. Exposed portions of the heat exchanger 30 and the piping sections between it and the storage tank 10 are preferrably also insulated.

Refrigerant suction port 43 in surge drum 40 couples evaporated refrigerant gas through a back pressure regulator valve 50 (not needed with some types of compressors) and a suction accumulator 51 (optional in most cases) to a refrigerant compressor and condenser system 52. The surge drum is preferrably sized to provide complete separation of gas and liquid refrigerant, but the suction accumulator, if included, will separate and accumulate any residual refrigerant liquid travelling with the gas and convert it into gas by evaporation over time. An oil return circuit (not shown) of standard design is preferrably provided between the oil return port 45 of the surge drum 40 and the suction accumulator 51 or the suction line to the compressor itself to remove oil from the liquid refrigerant in the surge drum and return it to the compressor 52. The oil return port 45 extends to the top surface of the pool of liquid refrigerant in the surge drum so that some of the oil rich liquid at the surface is removed for the oil return circuit.

Back pressure regulator 50 provides suction temperature control for installations in which a reciprocating compressor is utilized. In most screw compressor applications, this regulator is not required because the suction temperature can be controlled with the slide valve controller on the compressor itself. This slide valve controller is under the control of microprocessor controller 53 and suction temperature control can thus be programmed into the controller. A control system 55 for the overall system of this invention may then operate in concert with the controller on the compressor to provide suction temperature control for the different operating modes of the system described below.

Hot, high pressure liquid refrigerant at outlet line 54 from the refrigerant condenser 53 is coupled to the liquid refrigerant injector 75. Injector 75 is also coupled to the cold liquid port 42 of the surge drum 40. The outlet of the injector 75 is fed to the refrigerant inlet 35 of the heat exchanger 30. Injector 75 uses the higher pressure of the hot liquid refrigerant to carry with it a volume of the cold liquid refrigerant from the bottom of surge drum 40 through the injector into the inlet port 35. The operation of these components is described below in more detail.

FIG. 1 also shows a chilled water utilization circuit (or load) 80 coupled into the overall system. This utilization circuit may be, for example, the load side of an air cooling system in a commercial store or office building. Flow control valves 23–26 are shown in various locations in the overall chill water circuit to control flow of the heat transfer liquid and are turned on and off in various combinations to produce various operating modes of the overall system. These operating modes will be described below.

As shown in FIGS. 1 and 2, storage tank 10 has a large number of ice encapsulating units placed therein in a three dimensional array. The details of the structure of the individual ice encapsulating units will be described below, but FIG. 2 illustrates that the preferred configuration of ice encapsulating units permits them to be stacked in a way that produces liquid flow channels between the major top and bottom walls thereof. These liquid flow channels also provide space for expansion of the ice encapsulating units as the water inside freezes during the ice building cycle of the system.

As shown in FIGS. 1 and 2, a baffle 14 in the form of a section of flexible baffle made of rubber or a PVC material or other flexible material divides the interior of the tank into two separate flow channels so that liquid entering the inlet 13 flows over a bank of ice encapsulating units in the bottom section of the tank and then flows back toward the outlet 12 over a bank of ice encapsulating units in the top section of the tank. Baffle 14 is fastened to the front interior wall of the rounded front head of the tank and to the side interior walls of the tank so that liquid bypass around the baffle cannot occur. Any convenient method of securing the edges of the baffle to the inside walls of the vessel may be used. The baffle arrangement forces the liquid to take a long path through the storage tank and thus remain in contact with heat transfer surface of the ice encapsulating units for a long dwell time in the tank. An arrangement of three baffles could be used to provide a four pass compartmentalizing of the storage tank. Liquid distributing headers (not shown) are placed inside the tank at the inlet and outlet to ensure an even distribution in the flow of the liquid over the ice encapsulating units when entering and leaving the tank.

Access to the interior of storage tank 10 is provided through a manway 15 and the tank is optionally located at or above grade or buried underground. If buried underground, or installed where exposed to the weather, the exterior of the tank is coated to protect against corrosion.

The storage tank 10 is shipped to the installation site as a completely manufactured but empty tank, i.e. with no ice encapsulating units inside. The containers that form the ice encapsulating units 11 are also shipped empty to the installation site and filled with water at the site. At initial installation, the interior of the storage tank 10 is first filled with the ice encapsulating units and then the remaining volume of the tank is filled with a mixture of glycol (or other appropriate freeze point depressant chemical) and water. Since the ice encapsulating units expand during freezing, provision must be made in the overall structural arrangement to displace liquid from the interior of the tank during the ice building cycle. As shown in FIG. 1, a topping tank 100 is provided and is placed at a location in the structure served by the chill water system which is higher than the highest point to which the chilled water is to be pumped. A pipe 91 connects the bottom port 102 of the topping tank to a port 16 at the top of storage tank 10. The topping tank and the pipe 91 are filled with glycol and water during installation to a level of the overflow port 103 in the topping tank. This equalizes the static head pressure between the storage tank 10 and the chill water utilization circuit 80 so that liquid from the chill water utilization circuit will not back up into the storage module when the pumps are shut down.

Topping tank 90 is preferably constructed with a volume that is only a fraction of the total volume of liquid that is displaced from the storage tank during freezing of the ice encapsulating units. The overall structural arrangement also includes an inventory tank 93 is provided to store the overflow of displaced liquid and is connected to the topping tank through an overflow pipe 103 leading from the overflow port 103. Inventory tank 93 is preferrably installed at or near grade level. As liquid from the topping tank overflows into the inventory tank due to displacement by the ice encapsulating units, the height of the liquid in the inventory tank is a measure of the volume of ice that has been formed in the storage tank 10. During the ice building cycle, the liquid level guage 94 monitors the height of the liquid in the inventory tank and signals the control system 55 to turn off the refrigeration system 70 and the pumps 20 when the system is full of ice. The full level in the inventory tank is calibrated on initial system installation as the highest level of fluid displaced into it during the initial freeze cycle. It will be appreciated that the control system 55 could be arranged to be programmable to build a selectable percentage of the total ice storage capacity of the system. However, in most installations, the system will be operated to build and store a full charge of ice during each ice building cycle or as much ice as can be built during that cycle if an ice thawing, chill water production cycle is started before a full ice charge is accumulated.

During the ice thawing cycle, the volume of storage tank 10 occupied by the ice encapsulating units will decrease as the ice therein melts. As this occurs, volumes of liquid from the topping tank 90 will return to the storage tank 10 and the level in the topping tank will fall. A liquid level guage 100 in the topping tank signals a pump control 101 when the level drops and pump control 101 operates inventory pump 95 to pump liquid form the inventory tank 93 into the storage tank 10 via a pipe 97 leading to inlet 13. A one-way check valve 96 prevents reverse flow of liquid from the storage tank into the inventory tank. The inventory pump 95 could alternatively pump liquid directly into the topping tank 90 through a pipe 98. It should be understood that the topping tank and inventory tank shown in FIG. 1 are not to scale Sizes of various models of the components of the system will be discussed below.

FIG. 4 illustrates an alternative arrangment for handling the displacement of liquid from the storage tank during freezing and return of the displaced liquid during thawing of ice encapsulating units. In this embodiment, topping tank 110 is fabricated to hold the entire volume of liquid displaced from the storage tank so that a separate inventory tank is not required. A single level guage 113 reports the level of displaced liquid to the control system 55 so that it knows when the system is filled with ice. The displacement of liquid during the ice building cycle and the return of liquid during the ice thawing cycle happens automatically since the two tanks are directly connected. Of course the larger topping tank must be located at a place where its weight can be safely supported.

It will be understood that in some cases the storage tank itself may be mounted on the roof of the building or at the high point of the system. In this case the storage tank could be arranged to overflow directly into an inventory tank at grade level and the inventory pump could be used to pump liquid back to the storage tank on the roof. Alternatively, a topping tank could be mounted just above the storage tank and connected thereto for direct communication of displaced water between the two tanks.

System Operating Modes

Consider now the various operating modes of the system of the invention shown in FIG. 1. Chiller system 60 and refrigeration system 70 are designed to operate in two basic modes. The first mode is an ice building mode, during which the suction temperature regulating device is set for a minimum suction temperature of about twenty degrees F. The second mode is a live load chiller mode, during which the suction temperature is raised to a level appropriate to the higher temperatures entering and leaving the heat exchanger 30. This also increases the effective refrigeration tonnage of the system by as much as fifty percent.

FIG. 5 illustrates the operation of a typical "partial storage" installation of an ice building chill water system of this invention in an office building. It is a partial storage installation because the stored ice capacity is designed to be insufficient to supply all of the cooling required by the building on a typical design day. Instead, the refrigeration system will be operated to provide direct cooling during non-peak demand sections of the overall operating cycle, namely from seven a.m. to noon. Curve A shows the building load profile in tons of refrigeration required to cool the building at various times of the day. Curve B shows the ice inventory in the storage tank during various periods of operation. A linear ice charging curve is shown for simplicity although the actual curve is not a straight line. As shown, the chill water, air cooling system in this office building example is only operated during the hours from seven a.m. to six p.m. The installed system is designed for about 1500 ton hours of ice storage and the refrigeration system delivers 100 tons of refrigeration during the ice building period and up to about 150 tons of refrigeration when the system is operated in a live load chiller mode.

The Ice Building Mode

During the time period from six p.m. to seven a.m. the system is operating in the ice building or "charging" mode. Control system 55 has set the suction temperature at outlet port 43 of the surge drum at twenty degrees F and the refrigeration system is turned on. Valves 23 and 26 are open and valves 24 and 25 are closed so that the glycol/water solution is flowing through the heat exchanger 30 and the storage tank 10, but not through the load. The liquid leaving the storage tank will be at about twenty eight and one half degrees F and the liquid leaving the heat exchanger 30 and entering the storage tank will be at about twenty six degrees during most of this period.

Ice Building and Load Chilling Mode

At seven a.m. the building air cooling is switched on, and the system is set up to begin operating in a combination ice building and load chilling mode. The building cooling load is relatively low and the chiller system 60 can continue to provide twenty six degree fluid to the storage tank even if some of the circulating solution is pumped through and heated up by the building load. The pumps 20 will be maintained at full rated flow required for the ice building cycle, but valve 24 will be opened to circulate some of the chilled liquid through the load coils of the building. With the low building load, the return liquid in load outlet pipe 82 may only be about forty six degrees. When this returning liquid is blended with the larger amounts of twenty eight degree liquid leaving the storage tank, the liquid entering the inlet header 33 of the heat exchanger may only rise to about 29 degrees.

Live Load Chiller Mode

However, as the building load increases during the morning, eventually the system will not handle the load with the chiller operating in the ice building mode. At about ten a.m., the system is switched over to the live load chilling mode for about an hour to save the stored ice for the peak demand period. (If the storage tank 10 were fully charged with ice before 10 am, the system might be switched to the live load chiller mode at that time. This could happen during weather periods when the peak demand is lower than normal.)

In the live load chiller mode, the control system sets the suction temperature to a higher value, e.g. around forty degrees F. and the values 23 and 26 are closed while valves 24 and 25 are open. Pumps 20 are set to the lower flow rate required for the load side of the system. The heat transfer liquid thus is circulated directly between the chiller system 60 and the utilization circuit 80.

Live Load Chiller and Ice Thawing Mode

When the system operating in the live load chilling mode is no longer able to keep up with the cooling demand, the system is switched to the combined live load chilling and ice thawing (discharging) mode of operation. In the example, this occurs at about 11 a.m., prior to the start of the peak demand period at noon, and thus it is economical to continue operating the refrigeration system. The control system maintains the same suction temperature for the live load chilling mode of the chiller system 60, and the pumps 20 are operated at the same lower flow rate, but the valve 26 is opened to begin pumping the solution through storage tank 10. The chiller system cools the return water from the building load before it reaches the storage tank and the ice in the ice encapsulating units within the storage tank provides the remainder of the cooling to bring the solution to the design temperature.

The Ice Thawing Mode

At noon, the control system 55 shuts off the refrigeration system and the system begins operating in the ice thawing mode (or discharge mode). Pumping volume is kept at the low value required for the load side cooling coils in the utilization circuit 80. At 6 p.m. the utilization circuit is shut down, and the system is once more set to operate in the ice building (charging) mode during the evening and night hours.

The Ice Thawing and Refrigerant Condensing Mode

Figure 29:
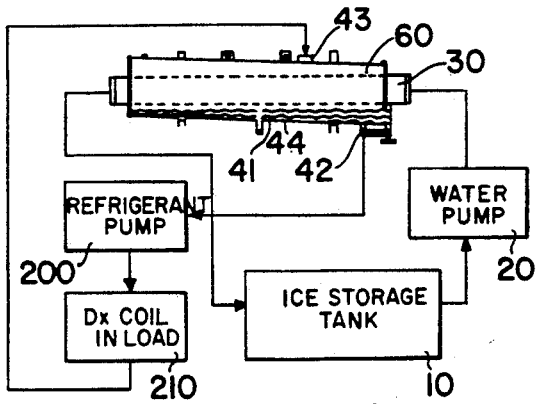
FIG. 29 is a schematic diagram of an alternative mode of operation of the system of this invention to provide cooling of a building load.

FIG. 29 illustrates another ice thawing operating mode for the system of this invention when used in installations which employ a standard DX coil in the load side for producing cooled air. Liquid refrigerant from the pool 44 at the bottom of surge drum 41 is drawn from the outlet port 42 and pumped by a refrigerant pump 200 to a DX coil 210 in the load circuit. The liquid refrigerant is evaporated in DX coil 210 and the refrigerant gas from the DX coil is piped back into the suction port 43 of surge drum 41. Water pump 20 is operated to pump chilled water from the ice storage tank 10 (with frozen ice encapsulating units therein) through heat exchanger 30 to cool the outer walls thereof to a temperature that will condense the refrigerant gas back to a liquid state.

This ice thawing mode of operation of the system can be used in retrofit installations without adding chilled water coils on the load side of the system. The same DX coils that are used for cooling the building air during off peak building hours, e.g. from eight a.m. to noon, by direct connection with the refrigeration system can be used during the peak period of the day. For installations which retain off peak operation of the regular air conditioning equipment and don't have a chilled water system already installed, use of this operating mode for thawing the ice in the storage tank can reduce the installation costs.

The Structure and Function of the Ice Encapsulating Units

FIGS. 6–8 and 9A illustrate configurations of ice encapsulating units that are preferred for use in the system of this invention. One configuration of ice encapsulating unit is the blowmolded polyethylene container 120 shown in FIGS. 6 and 7. Container 120 has the shape of a regular parallelepiped with major top and bottom walls 122 and 123 having length and width dimensions that are several times greater than the smaller dimensions of the side walls 124 and 125. Preferably this larger container 120 holds at least several gallons of liquid. The walls of the container are designed to have a thickness such that the walls are flexible and permit expansion of the internal volume of the container when the liquid inside freezes.

Figure 6:
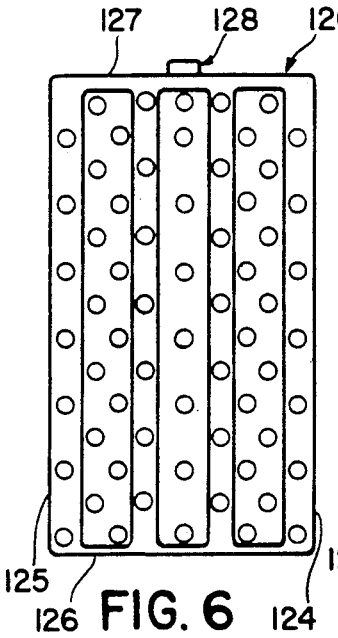
FIG. 6 is a plan view of one embodiment of an ice encapsulating unit in accordance with this invention.
Figures 7, 8:
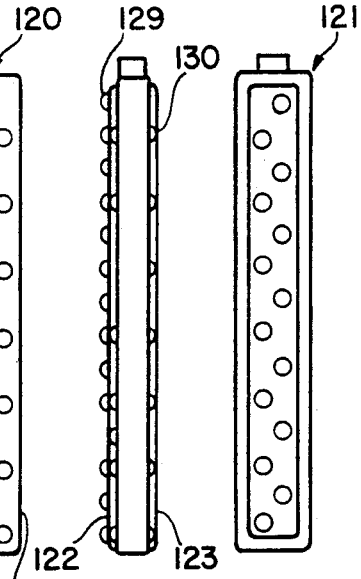
FIG. 7 is a side view of an embodiment of an ice encapsulating unit in accordance with this invention.
FIG. 8 is a plan view of another embodiment of an ice encapsulating unit in accordance with this invention.

By using the container shape shown in FIGS. 6 and 7, the ice encapsulating units are readily adapted to be stacked one on top of the other as well as side to side and end to end to form a three dimensional array of containers. Container 120 has an arrangement of projections 129A formed on the bottom wall thereof and also an arrangement of projections 130 on the top wall thereof. When two containers are stacked, these projections space the respective top and bottom walls away from each other to form liquid flow channels therebetween as illustrated in FIG. 9A.

Figure 9B:
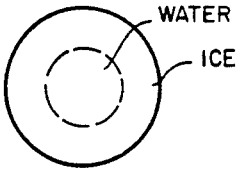
FIG. 9B (PRIOR ART)
FIG. 9B is a diagram illustrating features of ice encapsulating units of the prior art.
Figure 9A:
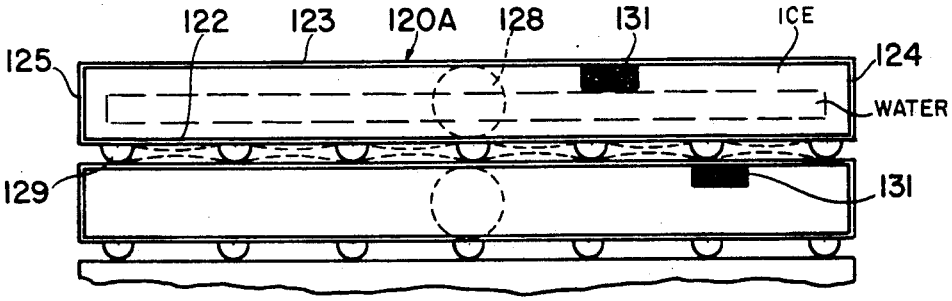
FIG. 9A is a diagram illustrating features of ice encapsulating units in accordance with this invention.

The containers 120A in FIG. 9A have an arrangement of projections 129A only on a bottom wall 122 thereof. This is considered the minimum type of configuration of projections to produce flow channels between container walls and space for expansion of the container walls during freezing. As shown by the dashed lines in FIG. 9A, during the freezing of the liquid inside the container, the top and bottom walls will bulge out into the flow channel between containers. This displaces some of the liquid in the flow channels and results in displacement of liquid into the topping tank as previously described.

As shown in FIGS. 6 and 7 the container 120 preferably has a cap arrangment 128 formed thereon. This cap arrangement comprises a threaded neck integrally formed on the container and a plastic screw on cap with a self adhesive liner (not shown) and a foam backing piece (not shown) mounts on the container neck to seal the container. It should be understood that this invention is not limited to use of any particular system for filling and sealing the ice encapsulating units. Other type of field installed sealing arrangements could be employed. In addition, this invention could also be implemented by filling and sealing the containers forming the ice encapsulating units at a factory site and shipping the filled units to the installation site. However, this approach substantially increases the shipping costs, so the preferred embodiment of this invention uses containers that are adapted to be shipped empty to the installation site and filled and sealed at that location. FIG. 8 illustrates a second configuration of a smaller container 121 that is useful to fill in gaps in the stack of containers that are too small for the larger container to fit.

As an example of container dimensions, the container 120 may have dimensions of sixteen by thirty by three inches and about a five gallon capacity. Container 121 may have dimensions of four by thirty by three inches and have about a 1.25 gallon capacity. These container configurations have been shown to work reasonably well in large storage tanks with a diameter between six and ten feet. The five gallon capacity of the larger containers produces a filled container weight of about forty pounds and is easily handled by an installation crew.

Based on experience with initial installations of the invention, it has been determined that it is preferrable to use a more narrow container to provide a greater ratio of surface area to volume. Containers with a side wall dimension in the range of one and one half to two inches and holding about two gallons of water are presently preferred. Generally it is preferred that the containers have at least about two square feet of surface area per gallon of contained liquid. It should, however, be understood that this invention is not limited to any particular size or configuration of container for the ice encapsulating units and the principles of the invention can be realized in a wide variety of designs and sizes.

It is also believed to be important to provide adequate separation between the overlying ice encapsulating units in order to have adequate flow of the working heat transfer liquid over the outer surfaces thereof. The presently preferred spacing is about three quarters of an inch, but this spacing dimension is not critical to the operation of the system. Larger spacing could also be used, but will reduce the volumetric ice storage efficiency as the spacing is increased. Generally, the spacing must provides flow channels between ice encapsulating units of adequate size during the entire freeze cycle with no substantial blockage of these channels as the container walls expand into the channel due to ice formation inside the ice encapsulating units.

As shown in FIG. 9A, a small volume of a freeze enhancement material, such as a piece of water pipe insulation sold under the trademark "Armaflex" and manufactured by Armstrong Corporation is placed inside each container before it is filled with liquid. A single, modestly sized piece of such material provides the freeze enhancement function. More than one piece does not appear to improve the operation during the freeze cycle. This freeze enhancement material seems to raise the temperature at which the liquid inside the container starts to freeze and has been shown in practice to be an important aspect of effective operation of the invention during the freeze cycle. As is well known, a contained body of liquid such as water must be subcooled as much as four or five degrees below the freezing point before the first ice crystals are formed therein. Once ice crystals begin to form, the liquid will then continue to freeze at the normal freezing temperature thereof. The presence of the freeze enhancement material in the container of water appears to raise the temperature at which initial ice crystals are formed.

It is not precisely known how or why this freeze enhancement material works. One plausible explanation is that the freeze enhancement material traps small volumes of water near the inner wall of the container and insulates them from heat transfer to the bulk of the liquid. The small volumes thus cool more quickly than the liquid otherwise in contact with the container walls and reach the initial freeze temperature more quickly. When ice crystals form in these small volumes, they serve as ice nucleating sites for adjacent volumes of liquid and the ice can begin to grow at the normal freezing temperature of the water. Use of deionized water also aids in the initial freezing process since its initial freezing temperature of 27.7° F. is slightly higher than that of tap water with typical levels of impurities.

Figure 10:
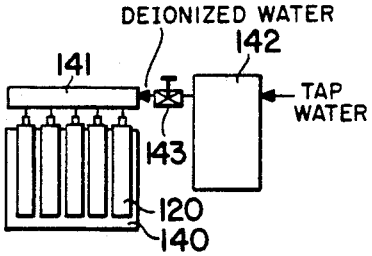
FIG. 10 illustrates a convenient system for filling ice encapsulating units with deionized water at the installation site.

The containers to be used in a installation of the system of this invention are shipped empty to the installation site, along with the caps and freeze enhancement material. For convenience in filling the containers, a container filling fixture illustrated schematically in FIG. 10 may be provided to the installers. The fixture 140 holds a plurality of containers 120 in vertical orientation and constrains the top and bottom walls of each container so that it will be filled to its normal capacity, i.e. the normal container volume without deformation of the top and bottom walls. Since the walls of the container are flexible, it is possible to load as much as eight gallons or more of water into a five gallon container with the sides expanding until the container is shaped like a rounded pillow. It is important to maintain the initial shape of the containers during filling so that the ice encapsulating units will stack in a more regular stacking pattern in the storage tank.

After the empty containers are loaded into the fixture 140, a flow distribution header is placed over the containers with the individual pipes on the bottom thereof inserted into the open necks on the containers. The distribution header 141 is connected to the outlet of a deionizer tank 142 which in turn is connected to a source of tap water. A valve 143 controls the flow of deionized water into the distribution header. Using this loading fixture arrangment, one group of the installation crew can be filling the ice encapsulating units while another group is installing the filled ice encapsulating units in the storage tank.

FIGS. 9A and 9B illustrate one advantage of using the preferred form of container according to this invention as depicted in FIG. 9A, compared to use of a spherical container as depicted in FIG. 9B. As shown in FIG. 9A, as ice is formed on the inner walls of container 120 A, there remains a large heat transfer surface at the liquid/ice interface within the container. The amount of heat transfer surface area does not decrease drastically as the ice is formed. The efficiency of heat transfer to the unfrozen liquid is reduced by the layer of ice, but the ratio of heat transfer surface to unfrozed liquid volume remains high. In contrast, in a spherical container as illustrated in FIG. 9B, the heat transfer surface area decrease dramatically as layers of ice form on the inner wall surfaces of the container.

Figure 11:
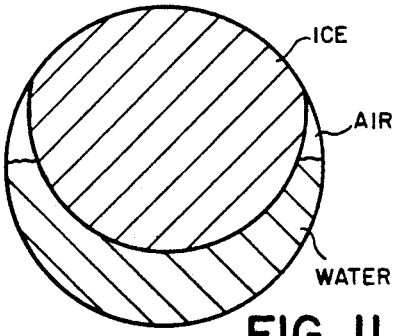
FIG. 11 (PRIOR ART)
FIG. 11 illustrates the ice melting characteristics of a prior art ice encapsulating unit in the form of a rigid sphere.
Figure 12:
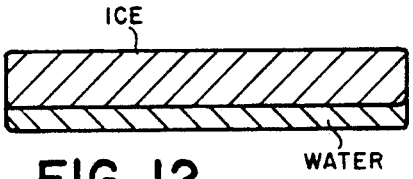
FIG. 12 illustrates the ice melting characteristics of a preferred configuration of ice encapsulating unit in accordance with this invention.

FIGS. 11 and 12 illustrate another advantage of using the configuration of container which is preferred for the system of this invention. In the prior art, as shown in FIG. 11, ice encapsulating units are formed as regular spheres which are typically only partially filled with water because the sphere cannot expand in volume. During thawing of the ice in the spherical container, the ball of ice will float to the top of the sphere and only a relatively small surface area of the ice will be in contact with the wall surface for direct conductive heat transfer. The remainder of the ice ball will be in contact with water and have a longer heat transfer path to the container wall. As the melting of the ball continues, the area of the ice ball in contact with the surface will enlarge because the contact area will melt faster than the surrounding area, but the percentage of the ice ball surface in direct contact with the wall of the sphere will remain small.

In contrast, the regular parallelepiped shape of the ice encapsulating units used in a preferred version of this invention keeps major portions of the top surface of the floating ice block in direct contact with or close proximity to the top wall of the container. This enhances the heat transfer from the container wall to the ice block and permits faster melting of the ice to produce the desired outlet chilled water temperature from the storage tank in which the frozen ice encapsulating units are contained.

The characteristics of the preferred form of ice encapsulating units in accordance with this invention also appear to provide improved freeze characteristics. During the ice building cycle, cracking noises are heard in the tank during the initial portion of the freezing cycle. It is believed that the initial ice layers formed on the inside walls of the container break into pieces and thus allow a liquid layer to contact the wall surface again. This enhances heat transfer and improves the rate of ice formation. The explanation for this phenomena is uncertain. It may be that it is caused by change in shape of the container walls as ice formation increases the internal volume.

Installations with Plural Chillers and Storage Tanks

Figure 13:
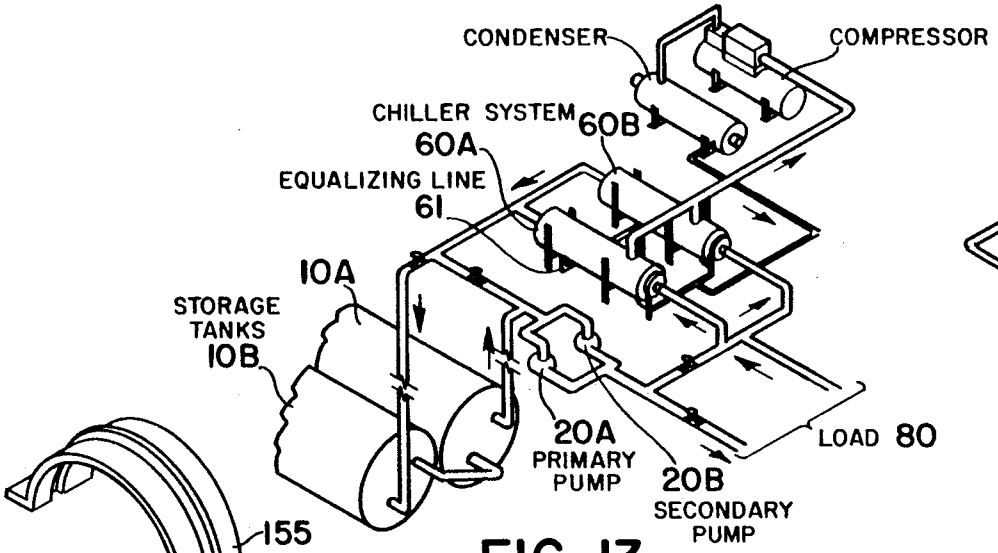
FIG. 13. illustrates an installation of an ice building, chill water system in accordance with this invention with parallel connected chiller systems and series connected storage vessels.

FIG. 13 illustrates an installation of a system of this invention in which two chiller systems 60A and 60B are connected in parallel for flow of water and for flow of refrigerant. Two separate storage tanks 10A and 10B are connected in series. An equalizing line 61 is connected between the two surge drums of the chiller systems to ensure uniform refrigerant charge levels in both. Two different pumping systems may be employed—a primary pump 20A for providing the high water flow rate through the heat exchangers during the ice building cycle and a secondary pump 20B for producing the lower water flow rate through the water coils in the load 80 during the ice thawing cycle or the live load chilling mode of operation of the chiller systems.

Rooftop Retrofit Installation

Figure 14:
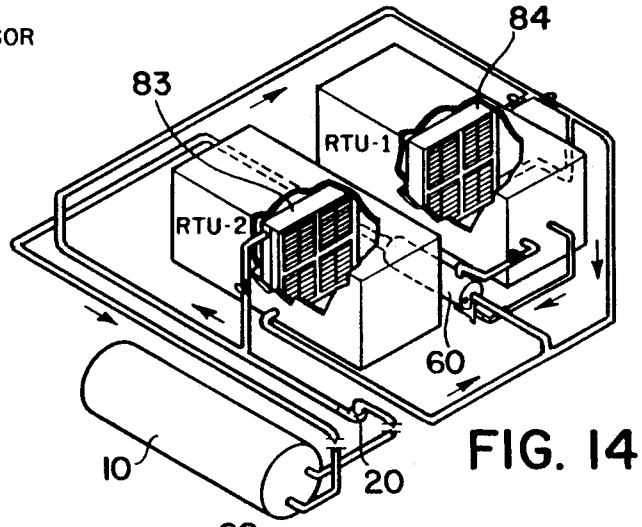
FIG. 14 illustrates use of an ice building, chill water system in accordance with this invention in a rooftop retrofit application.

FIG. 14 illustrates the facility with which the system of this invention can be used to retrofit typical rooftop air conditioning systems for thermal storage. The high side refrigeration section of RTU-1 is connected to the chiller system and provides the refrigeration for the ice building cycle during off peak electric usage periods. Chilled water coils 83 and 84 are added to each of the roof top units and piped to the storage tank 10 and chiller system 60 to serve as the chilled water load. A pump system 20 for the chilled water circuit is provided as in previously discussed installations. The topping tank and inventory tank and other components required to complete the overall system are not shown for simplicity of illustration, but would be included in the installation.

During off peak load periods, RTU-2 is operated in normal fashion with its existing refrigeration high side feeding the DX cooling coil therein to provide cooling to the building. If desired, the chiller system 60 could also be operated in a live load chiller mode to provide chilled water to the chill water coils in one or both of the units during off peak load periods. During the peak load period, the refrigeration system in both units is turned off, and the ice stored in storage tank 10 provides chilled water to circulate through the water coils in each unit.

In this type of installation, it is preferrable that the chiller system be located on the roof near the compressor in RTU-1. The storage tank can be located underground, on grade, or on the roof if there is adequate structural support. This type of installation illustrates the ability of the system of this invention to be adapted to a variety of retrofit applications and provide low first cost installation of thermal storage.

It should also be apparent that this type of rooftop retrofit application could use the ice thawing mode of operation of this invention illustrated in FIG. 29. In some installations, it may be possible to avoid the expense of adding water coils to the air handling portion of the rooftop system by using this alternative system configuration and different ice thawing mode.

Alternative Storage Tank System

Figure 16:
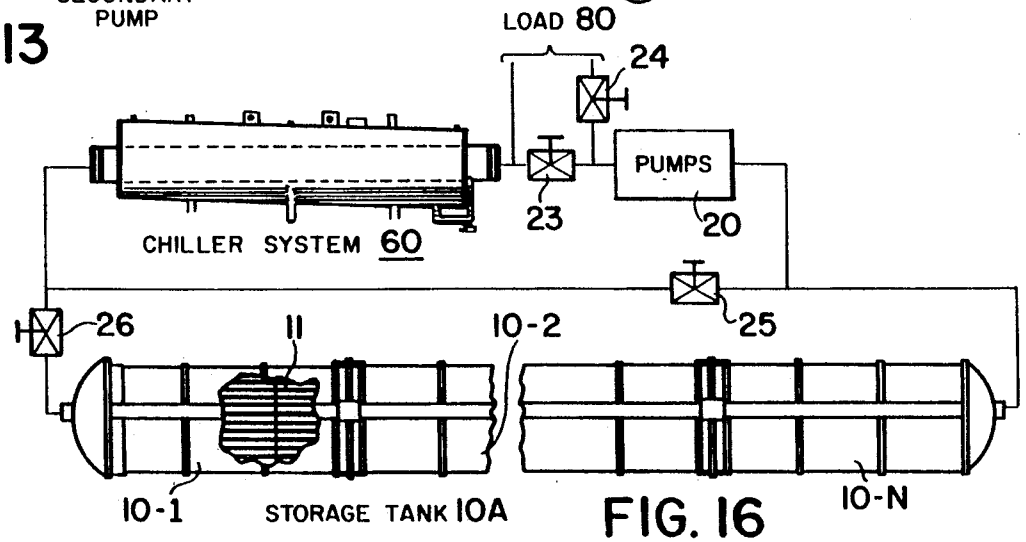
FIG. 16 illustrates the chill water circulation portion of a system in accordance with this invention using storage tank components of the type depicted in FIG. 15.
Figure 15:
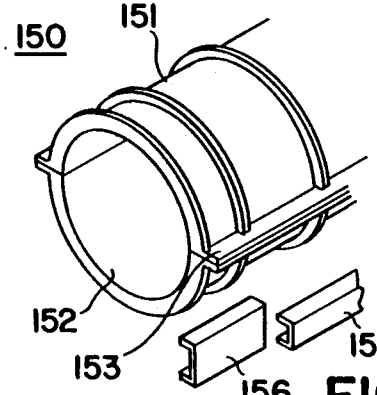
FIG. 15 illustrates the components utilized to form an alternative form of storage vessel in accordance with this invention.
Figure 17:
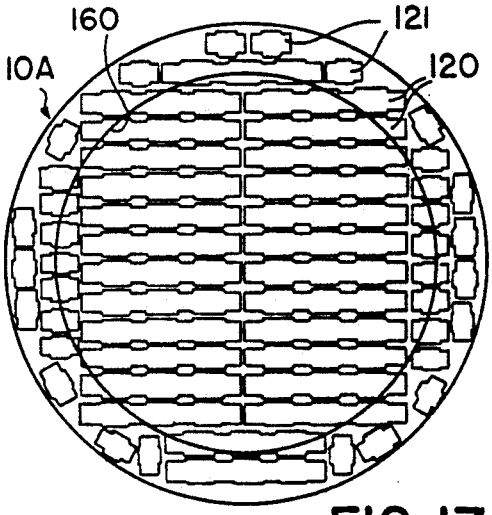
FIG. 17 illustrates one form of stacking pattern for ice encapsulating units in a storage vessel of the type shown in FIG. 16.

FIGS. 15–17 illustrate an alternative storage tank arrangement in accordance with this invention. In this arrangement, the ton-hour storage requirement for the installation is achieved by connecting together in series a plurality of sections of a special plastic pipe system 150 available from Magnus Incorporated of Dublin, Calif. The principal components of this special pipe system are illustrated in FIG. 15. Half cylindrical pipe sections 151 and 152 have longitudinal sealing flanges thereon which cooperate with seam clamps 154 and seam gaskets (not shown) to fasten the two pipe sections together with liquid tight side seams. Two half cylindrical coupling sections 155 (bottom one not shown) cooperate with end flanges on the pipe sections, O-ring sealing elements (not shown) and coupling clamps 156 to couple two assembled pipe sections together end to end with liquid tight seams.

This special piping system provides unique advantages when combined with the other system components of this invention. As shown in FIG. 16, a number of these pipe sections 10-1 through 10-N can be coupled together end to end to form a long storage tank. The components of the pipe sections can be shipped disassembled at low cost to the installation site. At the installation site they can be assembled by hand, avoiding the cost of large cranes to handle and place a heavy steel storage tank. As each pipe section is assembled, it can be loaded with ice encapsulating units and then coupled to the next assembled and loaded pipe section. The series connection of the pipe sections provides a long residence time for the solution pumped through the overall storage tank, ensuring that design chilled water temperatures can be achieved without installation of baffle systems. This "kit" approach to assembling the storage tank and the ice encapsulating units further lowers the overall manufacturing cost of the ice storage portion of the system of this invention and also reduces the labor cost for installation of the system.

This type of storage tank system also increases the flexibility of locating the ice storage portion of the system. For example, a long tank four feet in diameter could be hung from the ceiling next to the wall of a parking garage such that the hoods of parked cars will still fit under the tank. The more distributed weight of a longer tank with smaller diameter might permit its placement on the roof of a structure. This form of tank can be made self-insulating and the interior walls are inherently compatible with the material of the ice encapsulating units.

FIG. 17 illustrates one of the possible stacking patterns for the ice encapsulating units in the storage tank 10A of FIG. 16. Both the larger and smaller containers 120 and 121 shown in FIGS. 6–8 are employed. A baffle ring 160 may be placed in the storage tank between stacked courses of the ice encapsulating units to divert liquid from the larger flow paths near the inner wall of the storage tank. Other approaches to creating the appropriate flow channel areas could be used, such as packing the larger voids with other compatible materials to plug up the large flow channels that provide a low resistance flow path that detracts from flow through the smaller channels between ice encapsulating units.

Storage Tank Characteristics and Specifications

Figure 18:
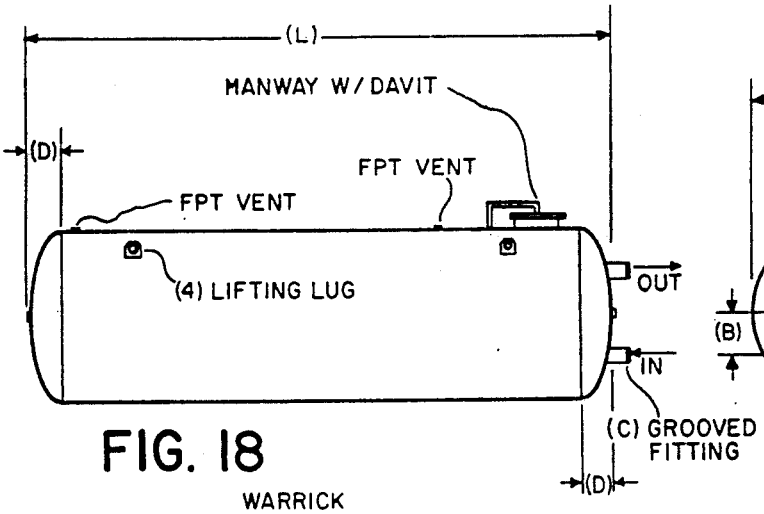
FIG. 18 is a side elevational view of a storage vessel in accordance with this invention.
Figure 19:
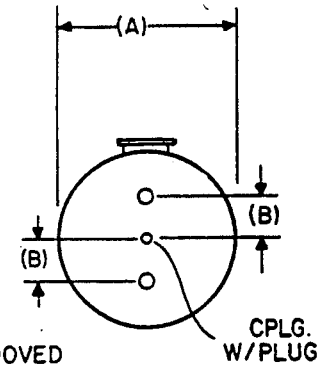
FIG. 19 is a front elevational view of a storage vessel in accordance with this invention.

Referring back to FIG. 1, in conjunction with FIGS. 18 and 19 and Tables I–III below, it will be seen that storage tank 10 may be manufactured in a variety of shapes and sizes to accommodate various ice storage levels from about 400 ton-hours to about 2700 ton hours in a single tank. For larger storage requirements, multiple tanks such as shown in FIG. 13 are required. Table I gives the basic storage tank specifications. Table II gives certain dimensions of the storage tank features based on the tank diameter and the number of passes or water flow channels created in the tank using the baffling arrangement described above. Table III gives the liquid flow rates for various inlet and outlet pipe sizes.

Using the ice encapsulating units of this invention in the storage tank, an ice storage efficiency between sixty five and seventy percent can be achieved. This compares with forty to sixty percent ice storage that is achievable with the prior art ice on coil and ice harvester systems. This improvement in ice storage efficiency in the system and method of this invention translates directly into space and cost savings in a commercial installation. The system of this invention can attain an efficiency of about 1.7 cubic feet per ton hour of storage compared to the three to five cubic feet per ton hour of storage required in most prior art systems. The load requirements of a particular project can be met with a smaller, less expensive storage tank.

Inventory Tank Structure and Specifications

Figure 20:
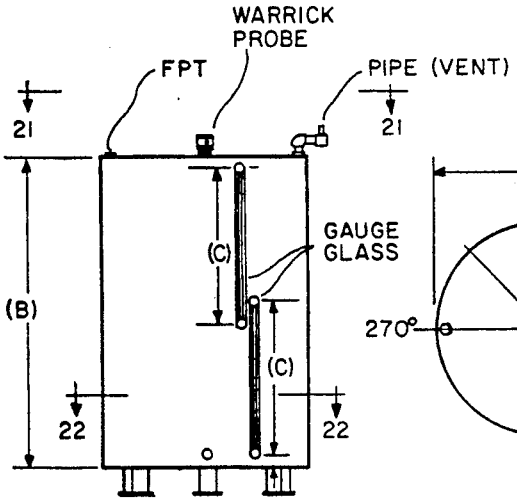
FIG. 20 is a side elevational view of a preferred form of inventory tank in accordance with this invention.
Figure 21:
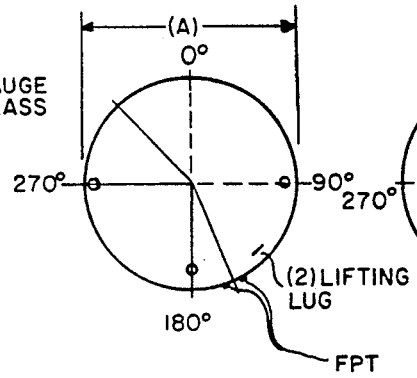
FIG. 21 is a top view of a preferred form of inventory tank in accordance with this invention.
Figure 22:
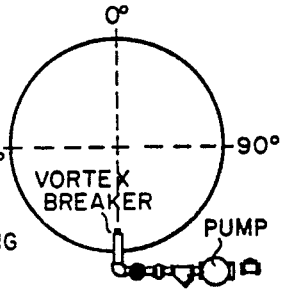
FIG. 22 is a section view of a preferred form of inventory tank in accordance with this invention taken along the lines 22—22 in FIG. 20.

Referring to FIG. 1 in conjunction with FIGS. 20–22 and Table IV, the details of inventory tank 93 and its dimensions and specifications are illustrated. The gauge glass arrangement on the side of the tank gives a manually readable indication of the volume of liquid in the inventory tank. On initial start up of the system, this gauge glass can be calibrated and marked to show the lowest level of liquid before starting the ice building cycle and the highest level after the ice encapsulating units have been completely frozen. The lowest level corresponds to zero ton hours of stored ice and the highest level corresponds to the rated ton-hour capacity of the system. Between these two marks or levels, the glass can be calibrated in a linear manner to indicate intermediate levels of ice storage in the system.

Topping Tank Structure and Specifications

Figure 23:
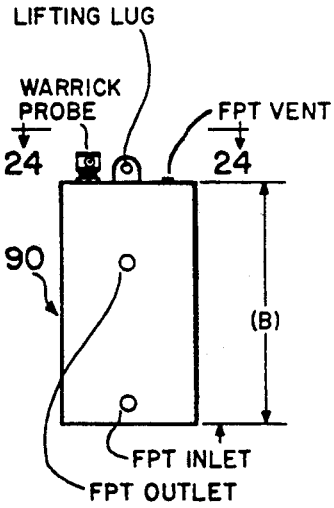
FIG. 23 is a side elevational view of a preferred form of topping tank in accordance with this invention.
Figure 24:
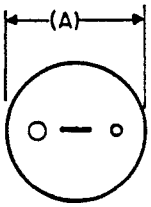
FIG. 24 is a top view of a preferred form of topping tank in accordance with this invention.

Referring to FIG. 1 in conjunction with FIGS. 23 and 24 and Table V, an example of a set of specifications and dimensions of topping tank 90 is illustrated. It should be understood that, for the topping tank arrangement of FIG. 4, the inventory tank models illustrated in FIGS. 20–22 and Table IV could be employed.

Chiller System Structure and Specifications

Referring back to FIG. 1 in conjunction with FIGS. 25–28 and Table VI, specific structural and operational details of chiller system 70 are illustrated. As shown, the chiller system is mounted in a frame which permits it to be mounted as a free standing floor unit. Alternative versions of frames could be provided for hanging the system from a ceiling. The frame also permits stacking chiller units on top of each other if desired.

Chiller system 70 may be manufactured in sizes from twenty five tons up to 175 tons. Larger capacity chillers could also be produced if desired. The fifty ton unit is designed to cool four hundred and eighty gallons per minute of a ten percent glycol solution from 28.5 degrees F. entering temperature to a 26.0 degrees F. leaving temperature when the suction pressure is maintained at 20.0 degrees F. and the condensing temperature is maintained at 105.0 degrees F. However, the operation of the system of this invention is largely head pressure independent. Condensing temperatures as low as 58 degrees F. can be used and still produce the liquid refrigerant pressure (minimum 100 psi) required to operate the injection system. The twenty five ton model uses the same operating parameters but has the capacity to cool two hundred and forty gallons per minute. Larger sizes of the chiller 70 have correspondingly larger cooling capacity.

The size of primary pump for pumping the glycol/-water solution through the chiller system depends on the model of chiller and its capacity. For example, for the fifty ton unit, a pump rated at fifteen horsepower at eighty feet of head is adequate. For a one hundred and seventy five ton unit, a pumping system rated at forty horsepower at eighty feet of head is required. The pump system must provide a water flow rate through the heat exchanger of 9.6 gallons per minute per ton. Thus a two hundred and fifty ton chiller unit requires about sixty five horsepower.

In each of the chiller units, the flow rate through the individual tubes 32 of the heat exchanger 30 is greater than twenty feet per second. This high velocity of liquid through the tubes together with the refrigerant liquid overfeed provide excellent heat transfer characteristics for the heat exchanger and produces the close approach operation that, in turn, results in efficient, low horsepower operation of the refrigerant circuit components.

The heat exchanger shell 31 is ten foot long schedule forty pipe. The diameter "G" of the shell varies depending on the size of the unit. In each unit, a three inch long header with Victaulic coupling grooves is provided for the water side connection. The fifty ton unit uses sixty four individual "304 stainless steel" tubes with one half inch outer diameter and 0.065 inch wall thickness. The twenty five ton unit uses half that number of the same tubes. Larger numbers of tubes are used in the larger units. The ends of the tubes are welded to the inside header wall. As shown in FIG. 3, a support ring and bar arrangement is welded to inside wall of the shell and supports the tubes at several intermediate locations. This maintains a uniform separation distance between the tubes throughout the length of the shell 31.

The tubes are spaced on about three-quarter inch centers. The strength rating of these tubes is such that they will not burst if the entire heat exchanger completely freezes up. They have a 2:1 safety margin in strength. Stainless steel tubes are used both for strength and for the fact that they are both corrosion and abrasion resistant. Copper tubes, for example, would erode under the high velocity water flow conditions in these units. Other metals having characteristics similar to stainless steel could also be used, but would be more expensive.

It should be understood that the invention is not limited to these dimensions for the heat exchanger and reasonable modifications could be made and still achieve effective chiller operation.

Figure 28:
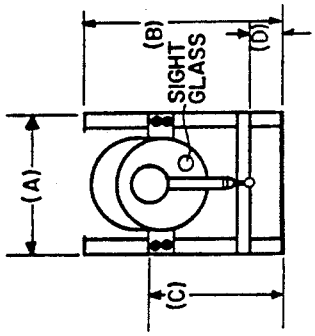
FIG. 28 is a front elevational view of a second configuration of a preferred form of chiller system in accordance with this invention.
Figure 27:
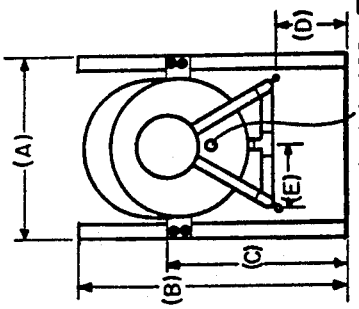
FIG. 27 is a front elevational view of a one configuration of a preferred form of chiller system in accordance with this invention.
Figure 25:
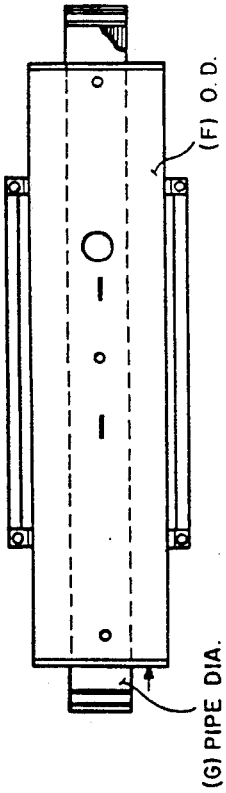
FIG. 25 is a top plan view of a preferred form of chiller system in accordance with this invention.
Figure 26:
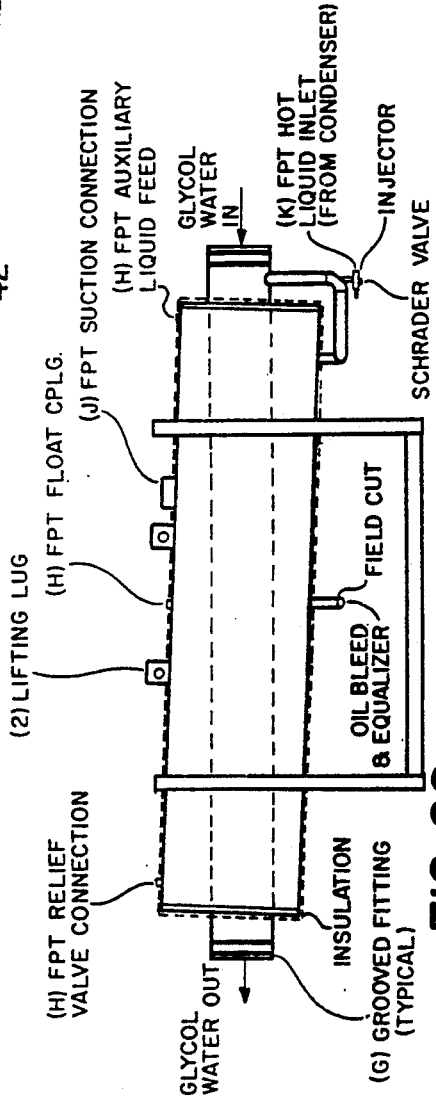
FIG. 26 is a side elevational view of a preferred form of chiller system in accordance with this invention.

The surge drum shell 41 is also schedule forty pipe with a diameter "F" as given in Table VI for the various sizes of units It has an overall length of nine feet. The shell of the surge drum and other exposed components are insulated to an R-8 level The surge drum is pitched three inches in ten feet to create a deeper pool of liquid refrigerant over the outlet port 42 and thus a greater head of liquid that makes the injector 75 work more efficiently. A sight glass is installed in the front wall of the surge drum, as shown in FIGS. 27 and 28 so that the level of refrigerant liquid in the drum can be visually monitored.

Figure 26A:
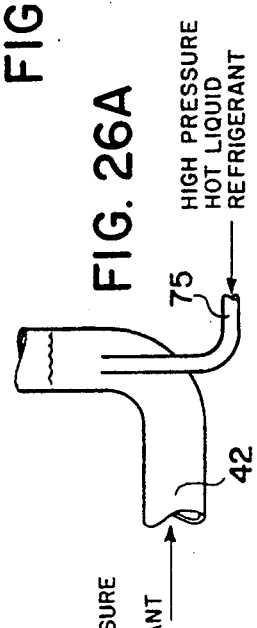
FIG. 26A is a schematic view of a liquid injector system useful in this invention.

The liquid refrigerant injector is a simple water jet design shown schematically in FIG. 26A. The nozzle for the high pressure hot liquid refrigerant should occupy twenty five to forty percent of the inner diameter of the combining tube for good operating efficiency. The sizing of these injector systems is appropriate to the size of the heat exchanger and the tonnage of the chiller system.

In the operation of a twenty five ton chiller unit, injector 75 brings in about two parts of cold liquid refrigerant from the outlet port 42 of the surge drum for each part of hot liquid refrigerant injected from from the condenser unit. The equivalent of one part of evaporated refrigerant exits the refrigerant suction port during steady state operation. As shown in FIG. 27, the chillers with capacity of one hundred tons and above use two injector ports to achieve the refrigerant flow rate required for refrigerant mass overfeed and efficient cooling of the heat exchanger tubes.

In steady state operation in the ice building mode, the suction temperature is maintained at twenty degrees F. and this refrigerant temperature is quite uniformly maintained throughout the length of the heat exchanger. During the initial cool-down of the glycol in the storage tank from a higher temperature, the suction temperature will also be higher, but will drop to the level set by the backpressure regulator valve (or the slide valve on the screw compressor) and be maintained there.

The inlet 35 and the outlet 36 are placed at opposite ends of the shell to avoid any short circuiting of the refrigerant flow for uniform heat transfer from one end to the other. The combination of the high mass flow of refrigerant through the heat exchanger shell and the boiling action of the refrigerant on the outside of the stainless steel tubes provides enhanced heat transfer characteristics.

The elongated cylindrical configuration of the surge drum provides a large surface area of liquid refrigerant for the gas to come boiling off. This also produces a low velocity of the gas which is preferable for the suction side of the system. The placement of the heat exchanger inside the surge drum enhances the refrigerant evaporation surface area since portions of that surface are wet with refrigerant liquid. It also avoids having to separately insulate the surge drum and the heat exchanger surfaces, makes use of all the cooling effect of the refrigerant evaporation, and reduces the refrigerant charge required for the system. It is normal to use between thirty and forty pounds of refrigerant per ton, but the system of this invention requires no more than eight pounds per ton of refrigeration. This is less than twice the amount of refrigerant charge used in a direct expansion air conditioning system of equivalent size.

It should be understood, however, that this invention is not limited to the use of the heat exchanger within the surge drum and these units could be separated and still achieve the principal benefits of the invention. The diameter of the surge drum is large enough that the use of a suction accumulator 51 can be avoided for most compressor types. The suction accumulator is recommended for use with hermetic compressors to ensure against liquid slugging. The refrigerant feed system has no moving parts and the system can be shut down without a pump down cycle.

The close approach of the outlet water temperature and the refrigerant temperature in the system of this invention is achieved by the overall design of the chiller system 60 including the refrigerant mass overfeed and the high velocity of the water (with glycol) flowing through the heat exchanger. This has the corresponding benefit that it reduces the concentration of glycol required to about ten to twelve percent. In systems where brine is circulated through plastic tubes to build ice on the outside of the tubes, glycol concentrations of up to twenty eight percent are required to keep the brine from freezing in the brine chiller. This higher concentration of brine reduces the heat transfer efficiency by ten or fifteen percent and also has other disadvantages listed above.

The chiller system of this invention is preferrably shipped with an oil return kit, including a hand expansion valve, to be connected between the oil bleed port 45 and the refrigerant suction line between the backpressure regulator (if used) and the compressor.

The system and method of this invention have been described in both general concept and specific embodiment to illustrate the principles of the invention. It should be understood that persons of ordinary skill in the art could make numerous changes in the details of implementation of the general system and method of this invention without departing from the scope of the invention as claimed in the following claims.

TABLE I

| MODEL NO. | TON HOURS | SIZE (FT) DIA./LENGTH | STORAGE TANK SPECIFICATIONS GALLONS GLYCOL/WATER | GALLONS LENS WATER | TOTAL GALLONS | LENS QUANTITY LARGE | SMALL |
|---|---|---|---|---|---|---|---|
| SM 2710 | 2669 | 10/56 | 8,761 | 21,523 | 30,284 | 4557 | 924 |
| SM 2510 | 2542 | 10/54 | 8,669 | 20,498 | 29,167 | 4340 | 880 |
| SM 2410 | 2415 | 10/52 | 8,577 | 19,473 | 28,050 | 4123 | 836 |
| SM 2310 | 2288 | 10/48 | 7,368 | 18,448 | 25,816 | 3906 | 792 |
| SM 2210 | 2161 | 10/46 | 7,276 | 17,423 | 24,699 | 3689 | 748 |
| SM 2010 | 2034 | 10/44 | 7,183 | 16,398 | 23,582 | 3472 | 704 |
| SM 1910 | 1907 | 10/42 | 7,091 | 14,374 | 22,465 | 3255 | 660 |
| SM 1810 | 1780 | 10/38 | 5,882 | 14,349 | 20,231 | 3038 | 616 |
| SM 1710 | 1652 | 10/36 | 5,790 | 13,324 | 19,113 | 2821 | 572 |
| SM 1510 | 1525 | 10/34 | 5,698 | 12,299 | 17,996 | 2604 | 528 |
| SM 1410 | 1398 | 10/30 | 5,605 | 11,274 | 16,879 | 2387 | 484 |
| SM 1309 | 1316 | 9/35 | 4,547 | 10,748 | 15,295 | 2236 | 624 |
| SM 1109 | 1113 | 9/31 | 4,401 | 9,095 | 13,496 | 1892 | 528 |
| SM 1009 | 1012 | 9/29 | 4,328 | 8,268 | 12,596 | 1720 | 480 |
| SM 908 | 945 | 8/33 | 3,499 | 7,718 | 11,217 | 1548 | 684 |
| SM 808 | 788 | 8/29 | 3,373 | 6,432 | 9,805 | 1290 | 570 |
| SM 707 | 672 | 7/31 | 2,431 | 5,485 | 7,916 | 1122 | 396 |
| SM 607 | 607 | 7/27 | 2,394 | 4,986 | 7,380 | 1020 | 360 |
| SM 506 | 497 | 6/32 | 2,034 | 4,056 | 6,090 | 828 | 300 |
| SM 406 | 414 | 6/28 | 1,933 | 3,380 | 5,313 | 690 | 250 |

TABLE IV

| MODEL NO. | CAPACITY TON-HOURS | INVENTORY MODULE DIMENSIONS A FT.-IN. | B FT. | C FT.-IN. | VOLUME GALLONS |
|---|---|---|---|---|---|
| IVM 2500 | 4400-2900 | 7-6 | 8 | 4-⅝ | 2500 |
| IVM 1600 | 2800-2100 | 6-0 | 8 | 4-⅝ | 1600 |
| IVM 1100 | 2000-1100 | 5-0 | 8 | 4-⅝ | 1100 |
| IVM 600 | 1000 & LESS | 4-0 | 6 | 3-⅝ | 600 |

TABLE II

| STORAGE MODULE DIMENSIONS A DIAMETER FT. | B 2-PASS FT.-IN. | B 4-PASS FT.-IN. | D HEAD DEPTH IN. |
|---|---|---|---|
| 6 | 1-3 | 1-5 | 13⅞ |
| 7 | 1-4 | 1-7 | 15⅞ |
| 8 | 1-7 | 1-10 | 17⅞ |
| 9 | 1-10 | 2-1 | 20 |
| 10 | 2-2 | 2-4 | 21⅞ |

TABLE III

| PIPE CONNECTIONS C IN. | FLOW RATE GPM |
|---|---|
| 6 | 0–800 |
| 8 | 800–1500 |
| 10 | 1500 & GREATER |

TABLE VI

| MODEL NO. | TONS | CHILLER SYSTEM SPECIFICATIONS DIMENSIONS (INCHES) A | B | C | D | E | F | G | H | J | K |
|---|---|---|---|---|---|---|---|---|---|---|---|
| LC175 | 175 | 32 | 46 9/16 | 31¾ | 12¾ | 11 | 24 | 12 | ¾ | 6 | ¾ |
| LC150 | 150 | 32 | 46 9/16 | 31¾ | 12¾ | 11 | 24 | 12 | ¾ | 6 | ¾ |
| LC125 | 125 | 32 | 46 9/16 | 31¾ | 12¾ | 11 | 24 | 10 | ¾ | 4 | ¾ |
| LC100 | 100 | 32 | 46 9/16 | 31¾ | 12¾ | 11 | 24 | 10 | ¾ | 4 | ¾ |
| LC75 | 75 | 24 | 34 9/16 | 23¾ | 8⅛ | — | 16 | 8 | ½ | 4 | ¾ |
| LC50 | 50 | 24 | 34 9/16 | 23¾ | 8⅛ | — | 16 | 6 | ½ | 3 | ½ |
| LC25 | 25 | 24 | 34 9/16 | 23¾ | 8⅛ | — | 16 | 6 | ½ | 3 | ½ |

TABLE V

| MODEL NO. | TOPPING RECEIVER DIMENSIONS A IN. | B IN. | VOLUME GALLONS | WEIGHT LBS. |
|---|---|---|---|---|
| TR-50 | 20 | 36 | 49 | 240 |
| TR-30 | 16 | 36 | 31 | 195 |

What is claimed is:

1. In a chilled liquid system, in combination:

structural means defining a first vessel means for containing a first volume of a first liquid characterized by a first freezing temperature and a second vessel means for containing a second volume of said first liquid, said second vessel means being in liquid transfer communication with said first vessel means;

a multiplicity of ice encapsulating units disposed in said first vessel means and occupying a major portion of the volume thereof, each of said ice encapsulating units comprising container means completely filled with a second liquid characterized by a second freezing temperature higher than said first freezing temperature and volume expansion during freezing, said container means having a parallelepiped shape with major top and bottom wall portions such that said container means are stackable top to bottom, side to side, and end to end to form a three dimensional array of said container means within said first vessel means, at least one of said top and bottom wall portions having a plurality of separated protruding means formed thereon to separate a top surface of each of said container means from a bottom surface of an overlying one of said container means and thereby forming liquid flow passages therebetween, said top and bottom wall portions having deformable wall structures to permit deformation of said walls into said liquid flow passages to increase the internal volume of said container means as said second liquid freezes and expands therewithin but without any major flexing or stressing of said deformable wall structures;

a liquid chilling system operatively associated with said first vessel means for cooling said first liquid in said vessel to an ice making temperature above said first freezing temperature and below said second freezing temperature to freeze said second liquid in each of said ice encapsulating units;

said first vessel means being completely filled with a combination of said ice encapsulating units and a volume of said first liquid; said second vessel means having therein a volume of said first liquid of a first value when the second liquid in said ice encapsulating units is entirely unfrozen and having therein a volume of said first liquid of a second value when the second liquid in said ice encapsulating units is entirely frozen, said second value being higher than said first value by the amount of expansion of said ice encapsulating units during freezing of said second liquid therein.

2. Apparatus as claimed in claim 1, further comprising indicating means for indicating a change in value of said volume of said first liquid in said second vessel means as said second liquid in said ice encapsulating units freezes or thaws, whereby said indicating means provides a measure of the volume of frozen portions of said second liquid in said ice encapsulating units.

3. Apparatus as claimed in claim 2, wherein said first vessel means is an closed tank and said second vessel means is a separate tank means connected in liquid communication to said first tank; and said indicating means is a gauge operatively associated with said separate tank means to indicate the volume of said first liquid therein.

4. Apparatus as claimed in claim 1 adapted for use with a chilled liquid utilization system having a predetermined highest point of utilization of said chilled liquid, further comprising means defining an ice building cycle and a chilled liquid utilization cycle;

said liquid chilling system being operative during said ice building cycle;

said first vessel means comprising a first, closed tank located at a position below said highest point of utilization; and said second vessel means comprising a second tank mounted at a position above said highest point of utilization and being connected by way of a pipe to said first, closed tank for automatic flow of portions of said first liquid between said first, closed tank and said second tank during said ice building cycle and said chilled liquid utilization cycle.

5. Apparatus as claimed in claim 4, wherein said second tank has a volume at least several times less than the total value of the expansion of said ice encapsulating units during said ice building cycle; and said second vessel means further comprises a third tank mounted at a position below said highest point of utilization and being connected in overflow relationship to said second tank; level indicating means operative during said chilled liquid utilization cycle for indicating when the volume of liquid in said second tank falls below a prearranged level; and pump means responsive to said level indicating means for pumping a volume of liquid from said third tank to said second tan said indicating means being operatively associated with said third tank for indicating the volume of liquid therewithin.

6. Apparatus as claimed in claim 5, further comprising controller means coupled to said indicating means for terminating the operation of said liquid chilling system when said indicating means indicates that a predetermined portion of said second liquid within said ice encapsulating units has been converted to ice.

7. Apparatus as claimed in claim 1, wherein said liquid chilling system comprises refrigeration and chiller means operatively associated with said chiller means for chilling said first liquid; and pump and valve means for controllably pumping said first liquid through a first liquid chilling circuit consisting of said first vessel means and said chiller means, through a second liquid chilling circuit consisting of said first vessel means and a chilled liquid utilization means, and through a third liquid chilling circuit consisting of said chiller means and a chilled liquid utilization means;

and further comprising controller means coupled to said liquid chilling system for defining a plurality of operating conditions comprising:

an ice charging condition during which said refrigeration and chiller means and said pump and valve means are operated solely for circulating volumes of chilled first liquid from said refrigeration and chiller means through said first vessel means for charging said ice encapsulating units with ice;

a live load chilling condition during which said refrigeration and chiller means and said pump and valve means are operated solely for circulating volumes of chilled first liquid from said refrigeration and chiller means through said chilled liquid utilization means; and a ice discharging condition during which said pump and valve means alone are operated for circulating volumes of chilled first liquid from said first vessel means through said chilled liquid utilization means.

8. Apparatus as claimed in claim 7, wherein said controller means further defines a combined charging and live load chilling condition and a combined live load chilling and discharging condition.

9. Apparatus as claimed in claim 8, further comprising indicating means coupled to said controller mean for indicating a change in value of said volume of said first liquid in said second vessel means as said second liquid in said ice encapsulating units freezes or thaws which is calibrated as a function of the volume of frozen portions of said second liquid in said ice encapsulated units and an accompanying value for total ton-hours of current ice storage, and said controller means further comprises means for shutting off said refrigeration and chiller means and said pump and valve means during said charging condition when said volume of said first liquid in said second vessel means has reached a preselected value corresponding to a preselected value of ton-hours of ice storage.

10. Apparatus as claimed in claim 9, wherein said first vessel means is a closed tank and said second vessel means is a separate tank means connected in liquid communication to said first tank; and said indicating means is a gauge operatively associated with said separate tank means to indicate the volume of said first liquid therein.

11. Apparatus as claimed in claim 10, adapted for use with a chilled liquid utilization system having a predetermined highest point of utilization of said chilled liquid, said first vessel means comprising a closed ice storage tank located at a position below said highest point of utilization and generally at or below grade level of a building in which said apparatus is installed; and said second vessel means comprising a second tank mounted at a position above said highest point of utilization and being connected by way of a pipe to said first tank for automatic flow of portions of said first liquid between said closed ice storage tank and said second tank during said ice building cycle and said chilled liquid utilization cycle.

12. Apparatus as claimed in claim 11, wherein said second tank is a topping tank having a volume at least several times less than the total value of volume expansion of said ice encapsulating units during a completed ice building cycle in which at least substantially all of the second liquid in said ice encapsulating units is converted to ice; and said second vessel means further comprises an inventory tank mounted at a position below said highest point of utilization and being connected in overflow relationship to said second tank;

level indicating means operative during said ice discharging condition for indicating when the volume of liquid in said second tank falls below a prearranged level; and pump means responsive to said level indicating means for pumping a volume of liquid from said third tank to said second tank either directly or through said closed ice storage tank;

said indicating means being operatively associated with said inventory tank for indicating the volume of liquid therewithin and, by way of a calibration, the corresponding ton-hours of ice storage in said closed ice storage tank.

13. Apparatus as claimed in claim 12, wherein said closed ice storage tank comprises comprises a plurality of individual tank sections having a diameter less than about six feet and being coupled in a series liquid flow connection pattern, each of said tank sections being filled with a three dimensional array of said ice encapsulating units.

14. Apparatus as claimed in claim 1, adapted for providing chilled liquid to an air cooling system of a building using a first vessel means in the form of a closed ice storage tank adapted to be mounted at or below grade level of said building, and further comprising:

means for controllably pumping said first liquid through a circuit comprising said closed ice storage tank and said air cooling system to provide cooling of said building accompanied by gradual melting of portions of ice within said ice encapsulating units in said closed ice storage tank;

a topping tank mounted above the highest point of said air cooling system in said building to which said chilled liquid is to be supplied, said topping tank being open to atmospheric pressure and having an inlet port in a lower wall section thereof and an outlet port formed in an upper wall section thereof, said inlet port being connected to said closed ice storage tank to receive volumes of said first liquid displaced therefrom as ice is formed in said ice encapsulating units during an ice charging cycle, said topping tank having a volume comprising a small fraction of the total volume of liquid displaced from said vessel when substantially all of said second liquid in all of said ice encapsulating units in said closed ice storage tank is completely frozen;

as inventory tank adapted to be mounted at or near grade level, said inventory tank being open to the atmosphere and having an inlet port at an upper wall portion thereof and an outlet port at a lower wall portion thereof; said inlet port being connected to said outlet port of said topping tank to communicate overflow volumes of said first liquid from said topping tank to said inventory tank, said inventory tank having a volume at least as large as the total volume of liquid displaced from said vessel when substantially all of said second liquid in said ice encapsulating units in said closed ice storage tank is completely frozen;

inventory pumping means connected to said outlet port of said inventory tank for pumping volumes of said first liquid from said inventory tank to said topping tank either directly or through said closed ice storage tank;

first level gauging means mounted in said topping tank;

second level gauging means mounted in said inventory tank;

pump control means coupled to said first level gauging means for turning on said inventory pumping means when the liquid level in said topping tank falls to a prearranged lower level and turning off said inventory pumping means when the liquid level in said topping tank rises to a prearranged upper level; and control means coupled to said second level gauging means for turning off said liquid chilling system when the level of liquid in said inventory tank rises to a precalibrated level indicating that a preselected portion of the total volume of said second liquid in said ice encapsulating units is frozen and thus a preselected value of ton-hours of ice storage has been attained.

15. The system of claim 1, wherein each of said ice encapsulating units in a first group thereof comprises a molded plastic container of a first configuration characterized by top and bottom wall portions having a width dimension value at least several times greater than the height dimension of the side and end walls thereof and thereby providing a large ratio of heat transfer surface to internal volume, said first group of containers comprising a large majority of said ice encapsulating units in said three dimensional array; each of said ice encapsulating units in a second group thereof comprising a molded plastic container of a second configuration characterized by top and bottom wall portions having a width dimension a predetermined fraction of said width dimension value of said containers of said first group, said containers of said second group being used to fill gaps in said three dimensional array of containers that are smaller than said containers of said first group.

16. In a thermal storage system adapted for supplying chilled liquid to a chilled liquid utilization system, in combination:

a first vessel for containing a volume of a first liquid characterized by a first freezing temperature;

a multiplicity of ice encapsulating units disposed in said first vessel and occupying a major portion of the volume thereof, each of said ice encapsulating units being filled with a second liquid having a second freezing temperature higher than said first freezing temperature, and each of said ice encapsulating units being characterized by volume expansion and volume contraction during freezing and thawing, respectively, of said second liquid therewithin;

a liquid chilling system operative during an ice building operating cycle for cooling said first liquid in said first vessel to a temperature above said first freezing temperature and below said second freezing temperature and thereby to freeze said second liquid in said ice encapsulating units;

pumping means operative during an ice thawing cycle for circulating said first liquid in said first vessel through said chilled liquid utilization system, thereby heating said first liquid above said second freezing temperature to thaw ice formed in said ice encapsulating units during said ice building cycle; and liquid overflow means including a second vessel adapted to be positioned at a level higher than said first vessel and pipe means directly coupling said first vessel and said second vessel for automatic flow of portions of said first liquid from said first vessel to said second vessel due to volume expansion of said ice encapsulating units during said ice building cycle and for automatic flow of portions of said first liquid from said second vessel to said first vessel due to volume contraction of said ice encapsulating units during said ice thawing cycle.

17. The system of claim 16, further comprising measuring means for measuring the volume of said first liquid displaced from said first vessel as a measure of the volume of ice contained within said ice encapsulating units.

18. The system of claim 17, further comprising controller means coupled to said measuring means for terminating the operation of said liquid chilling system when said measuring means indicates that a predetermined portion of said second liquid within said ice encapsulating units has been converted to ice.

19. The system of claim 16 adapted for use with a chilled liquid utilization system having a predetermined highest point of liquid utilization, wherein the total volume of portions of said first liquid flowing from said first vessel to said second vessel during said ice building cycle has a predetermined maximum liquid displacement value; said liquid overflow means further includes a third vessel; said second vessel having a second vessel volume value comprising a preselected fraction of said maximum liquid displacement value and being adapted to be mounted in a location higher than said highest point of liquid utilization; said third vessel having a third vessel volume value at least equal to the difference between said second volume value and said maximum liquid displacement value, overflow pipe means coupling said second vessel to said third vessel for communicating overflow volumes of said first liquid therebetween during said ice building cycle, level detecting means disposed in said second vessel for signaling when said first liquid therein falls below a preset level, and pumping means operated in response to said level detecting means for pumping a volume of said first liquid from said third vessel to said second vessel to maintain a preset level of said first liquid in said second vessel during said ice thawing cycle.

20. In a method for producing a chilled liquid for thermal storage, the steps of:

forming an arrangement of interconnected vessels including the steps of forming a first vessel means for containing a volume of a first liquid characterized by a first freezing temperature; and forming a second vessel means in liquid communication with said first vessel means;

forming a multiplicity of ice encapsulating units by the steps of forming a large number of hollow plastic containers characterized by a parallelepiped shape with at least one of the major top and bottom wall portions thereof having a plurality of separated protruding means thereon and deformable wall structures to permit increases in internal volume of said container;

filling said containers with a second liquid characterized by a second freezing temperature substantially above said first freezing temperature; and sealing said containers against escape of said second liquid;

placing said ice encapsulating units in said first vessel means in a three dimensional array of overlying, and side-by-side and end-to-end units with said protruding means forming liquid flow channels between overlying ones of said units;

filling at least said first vessel means entirely with said first liquid except for volumes occupied by said ice encapsulating units; and chilling said first liquid during an ice building cycle to a temperature above said first freezing temperature and substantially below said second freezing temperature for a period of time sufficient to freeze at least a portion of said second liquid in said ice encapsulating units, a portion of said first liquid flowing into said second vessel means during said ice building cycle.

21. The method of claim 20 adapted for supplying chilled liquid to a utilization system having a prearranged highest point of utilization, wherein said step of forming an arrangement of interconnected vessels comprises:

forming a closed vessel as said first vessel means;

forming an open atmospheric topping tank as said second vessel means and placing said topping tank at a location higher than said highest point of utilization; and connecting said topping tank directly to said closed vessel;

said step of filling said first vessel means includes partially filing said topping tank with said first liquid;

and further comprising the step of circulating said first liquid through said closed vessel and said utilization system during an ice thawing cycle;

whereby, during said ice building cycle, additional volumes of said first liquid are automatically communicated from said closed vessel to said topping tank as said ice encapsulating units increase in volume due to formation of ice therewithin, and during said ice thawing cycle, volumes of said first liquid are automatically returned from said topping tank to said closed vessel as said ice encapsulating units decrease in volume due to melting of ice therewithin.

22. The method of claim 21, wherein the total volume of first liquid displaced from said closed vessel during said ice building cycle is a predetermined maximum displacement value; said open atmospheric topping tank is formed with a volume a fraction of said maximum displacement value; and said step of forming an arrangement of interconnected vessels further includes the steps of forming an open atmospheric inventory tank; and connecting said topping tank to said inventory tank so that said liquid in said topping tank overflows into said inventory tank; and said method further comprises the steps of:

sensing the level of liquid in said inventory tank as a measure of the volume of ice in said ice encapsulating units;

terminating said ice building cycle when the volume of ice in said ice encapsulating units is at a preselected value;

sensing the level of liquid in said topping tank during said ice thawing cycle to produce a low level signal when said level drops to a preset minimum level; and communicating a volume of said first liquid from said inventory tank to said topping tank in response to said low level signal.

* * * * *